US006739923B2

(12) United States Patent
Murakami

(10) Patent No.: US 6,739,923 B2
(45) Date of Patent: May 25, 2004

(54) ENGINE ALIGNMENT JIG ASSEMBLY FOR SMALL WATERCRAFTS AND METHOD OF POSITIONING ENGINE USING THE SAME

(75) Inventor: Masatoshi Murakami, Hamamatsu (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/338,991

(22) Filed: Jan. 9, 2003

(65) Prior Publication Data

US 2003/0129894 A1 Jul. 10, 2003

(30) Foreign Application Priority Data

Jan. 9, 2002 (JP) ..... 2002-002216

(51) Int. Cl.[7] ..... B63H 21/30
(52) U.S. Cl. ..... 440/111; 440/112; 440/83
(58) Field of Search ..... 440/111, 112, 440/113, 83

(56) References Cited

U.S. PATENT DOCUMENTS 3,580,211 A * 5/1971 Kurashiki et al. ..... 114/65 R
4,957,462 A * 9/1990 Erickson ..... 440/111

FOREIGN PATENT DOCUMENTS

JP 2000-062688 A 2/2000

* cited by examiner

*Primary Examiner*—Sherman Basinger
(74) *Attorney, Agent, or Firm*—Rankin, Hill, Porter & Clark LLP

(57) ABSTRACT

An engine alignment jig assembly, which is used for installing an engine in a hull of a small watercraft via four engine mounts in such a manner that an output shaft of the engine is in alignment with a rotating shaft of a jet pump, is disclosed. The jig assembly includes an engine lower part dummy constructed to resemble a lower half of the engine. The engine lower part dummy includes a generally rectangular skeleton frame having substantially the same size in plan view as the lower half of the engine. Four screws are each provided at a respective corner of the rectangular skeleton frame and adapted to be threaded in a corresponding one of the engine mounts to attach the engine lower part dummy to the engine mounts. Two adjacent ones of the screws that are disposed on a bow side of the watercraft form left and right front screws, and the remaining two screws that are disposed on a stern side of the watercraft form left and right rear screws. A front through-hole is formed in the skeleton frame with a center thereof disposed between the left and right front screws and aligned with an axis of the rotating shaft of the jet pump, and a rear through-hole is formed in the skeleton frame with a center thereof disposed between the left and right rear screws and aligned with the axis of the rotating shaft of the jet pump. An engine installing method using the jig assembly is also disclosed.

37 Claims, 24 Drawing Sheets

ENGINE ALIGNMENT JIG ASSEMBLY FOR SMALL WATERCRAFTS AND METHOD OF POSITIONING ENGINE USING THE SAME

FIELD OF THE INVENTION

The present invention relates to an engine alignment jig assembly for positioning the output shaft of an engine to a correct position when the engine is installed in the hull of a small watercraft, and a method of positioning the engine using such engine alignment jig assembly.

BACKGROUND OF THE INVENTION

Various types of planing watercrafts are known. One such known planing watercraft is a jet propulsion watercraft, in which a jet pump installed in a rear part of a hull is driven by an engine to rotate an impeller thereof so that water is pumped up from the bottom of the hull and a pressurized stream of water is ejected backward of the hull to thereby propel the watercraft. Since the impeller of the jet pump is designed to rotate at high speeds within the stator, the stator needs to be correctly positioned with respect to the impeller.

Japanese Patent Laid-open Publication No. 2000-62688 (JP 2000-62688 A) discloses a jet propulsion unit mounting structure of a small boat, in which for correct positioning of a stator relative to an impeller, a vertical positioning first claw and a horizontal positioning second claw are provided on a hull of the boat so that they are in abutment with a first stopper portion and a second stopper portion, respectively, of a stator thereby to position the stator in both vertical and horizontal directions.

Additional to the positioning of the stator relative to the impeller, it is also important that a rotating shaft of the impeller is aligned with the output shaft of an engine to secure transmission of power from the engine to the impeller. To this end, when the engine is installed in the hull, the output shaft of the engine is aligned with the rotating shaft of the impeller. A conventional engine output-shaft alignment operation will be described with reference to FIG. 25.

As shown in FIG. 25, a small planing watercraft includes an engine 152 installed in a hull 150 of the watercraft via four engine mounts 151 (two being shown). The engine mounts 150 are attached to the hull 150. The engine 152 has an output shaft 153 connected via a coupling assembly 154*a*, 154*b* to a drive axle or shaft 155. The drive shaft 155 has a rear end spline-connected to a rotating shaft 157 of an impeller 156. Rotation of the engine output shaft 153 can thus be transmitted to the impeller 156. To secure smooth connection of the engine output shaft 153 and the impeller rotating shaft 157 via the drive shaft 155, the engine output shaft 153 must be aligned with the rotating shaft 157 of the impeller 156.

To this end, in the process of installing the engine 152 in the hull 150, the impeller 156 is assembled within a stator 158, and the drive shaft 155 is spline-connected to the rotating shaft 157 of the impeller 156. Then, the engine 152 while being lifted by a crane (not shown) is moved up and down, left and right or forward and backward until the output shaft 153 of the engine 152 is correctly aligned with the drive shaft 155

During that time, in order to secure correct alignment between the engine output shaft 153 and the drive shaft 155, a fine positional adjustment of the engine 152 is needed wherein the engine 152 is moved bit by bit in almost all directions. At the same time, the engine 152 must be also positioned relative to the engine mounts 151. However, since the engine 152 is a heavy component, the foregoing engine positioning operation requires a dexterous crane work, which will impose a great burden on the operator. Thus, the conventional engine installation work requires a relatively long time, and the productivity of the small planing watercraft is relatively low.

SUMMARY OF THE INVENTION

It is, accordingly, an object of the present invention to provide an engine alignment jig assembly for a small watercraft, which enables the operator to position an engine correctly in a relatively short time without requiring dexterity, thereby reducing the necessary engine installation time.

Another object of the present invention is to provide a method of positioning an engine using such jig assembly.

According to a first aspect of the present invention, there is provided an engine alignment jig assembly used for installing an engine in a hull of a small watercraft via four engine mounts in such a manner that an output shaft of the engine is in alignment with a rotating shaft of a propulsion unit of the watercraft. The engine alignment jig assembly comprises an engine positioning jig for positioning the engine mounts relative to the rotating shaft of the propulsion unit, the engine positioning jig including an engine lower part dummy constructed to resemble a lower half of the engine. The engine lower part dummy includes a generally rectangular skeleton frame having substantially the same size in plan view as the lower half of the engine, four screws each provided at a respective corner of the rectangular skeleton frame and adapted to be threaded in a corresponding one of the engine mounts to attach the engine lower part dummy to the engine mounts, wherein two adjacent ones of the screws that are disposed on a bow side of the watercraft form left and right front screws, and the remaining two screws that are disposed on a stern side of the watercraft opposite the bow side form left and right rear screws, a front through-hole formed in the skeleton frame with a center thereof disposed between the left and right front screws and aligned with an axis of the rotating shaft of the propulsion unit, and a rear through-hole formed in the skeleton frame with a center thereof disposed between the left and right rear screws and aligned with the axis of the rotating shaft of the propulsion unit.

Since the engine lower part dummy is much smaller in weight than a real engine, so that positioning of the engine mounts can be achieved easily in a relatively short time without requiring a dexterous crane work. A subsequent engine mount work does not require adjustment of the position between the engine and the engine mounts, so that the watercraft can be manufactured with improved productivity and at a relatively low cost.

Preferably, the engine positioning jig further includes a centering shaft adapted to be inserted through the front and rear through-holes of the engine lower part dummy while assuming a position of the rotating shaft of the propulsion unit, so as to position the engine mounts with respect to a vertical direction, a widthwise direction and a lengthwise direction of the watercraft through displacements of the engine lower part dummy in the respective directions relative to the centering shaft.

In one preferred form of the invention, the front through-hole of the engine lower part dummy has an inside diameter smaller than an inside diameter of the rear through-hole, the centering shaft includes a first portion and a second portion coaxial with each other and adapted to be simultaneously received in the front and rear through-holes, respectively, such that a loose fit is formed between each of the through-holes and a corresponding one of the shaft portions, and the engine positioning jig further includes means for determining an offset in the vertical direction of the center of each through-hole from an axis of the corresponding shaft portion. The means for determining an offset comprises a gauge block having a series of steps formed on one side thereof and adapted to be inserted between each through-hole and the corresponding shaft portion. The skeleton frame may have a groove extending radially outward in a vertical direction from each of the front and rear through-holes for receiving part of the gauge block. Alternatively, the means for determining an offset may comprise an ultrasonic depth indicator provided on the skeleton frame adjacent each of the front and rear through-holes for measuring a vertical thickness of a clearance between each through-hole and the corresponding shaft portion.

The centering shaft may further include a third portion and a fourth portion coaxial with each other and adapted to be simultaneously received in the front and rear through-holes, respectively, such that a sliding fit is formed between each of the through-holes and a corresponding one of the shaft portions, the third and fourth shaft portions being disposed behind the first and second shaft portions, respectively, when viewed in a direction of insertion of the centering shaft through the front and rear through-holes.

The engine lower part dummy may further include a lock device engageable with a part of the centering shaft to lock the engine lower part dummy in position against movement relative to the centering shaft in an axial direction of the centering shaft. Preferably, the centering shaft further has a circumferential groove disposed adjacent the third shaft portion, and the lock device has a hollow case mounted to the skeleton frame adjacent the front through-hole and having an open end facing toward a common axis of the front and rear through-holes, a pair of locking prongs slidably received in the case and snugly receivable in the circumferential groove of the centering shaft, and a spring acting between the case and the locking prongs to urge the locking prongs in a direction to project outward from the open end of the case. The locking prongs are symmetrical in configuration with respect to a vertical plane passing through the center of the front through-hole.

Preferably, for use with a watercraft having a propulsion unit composed of a jet pump mounted via a thrust plate to a vertical wall of the hull, the engine positioning jig further includes a pump dummy adapted to be mounted to the thrust plate and having a plurality of coaxial support holes slidably receptive of longitudinal portions of the centering shaft for supporting the centering shaft in such a manner that the centering shaft assumes the position of the rotating shaft of the jet pump. The centering shaft may further include a semicircular flange, and the pump dummy has a substantially semicircular locking projection extending along a half of the perimeter of one of the support holes and releasably engageable with the semicircular flange to lock the centering shaft in position against axial movement relative to the pump dummy.

Preferably, for use with a watercraft having a propulsion unit composed of a jet pump mounted via a thrust plate to a vertical wall of the hull, and a pair of coupling members provided on the output shaft of the engine and a rotating shaft of the jet pump to join the output shaft and the rotating shaft, the engine alignment jig assembly further comprises a position inspection jig for inspecting the position of the output shaft of the engine which has been mounted on the engine mounts positioned by using the engine positioning jig. The position inspection jig includes an inspection pump dummy adapted to be mounted to the thrust plate and having a plurality of support holes coaxial with the rotating shaft of the jet pump, an inspection shaft adapted to be inserted through the support holes of the inspection pump dummy so as to assume the position of the rotating shaft of the jet pump, and an inspection coupler adapted to be slidably mounted on an end portion of the inspection shaft for movement toward and away from one coupling member on. the output shaft so as to inspect the coupling member for axial position and alignment error relative to the other coupling member on the rotating shaft of the jet pump.

In one preferred form of the invention, the position inspection jig further includes a lock device for locking the inspection shaft in position against axial movement relative to the inspection pump dummy. The inspection coupler has a cylindrical wall having an inside diameter slightly larger than an outside diameter of the coupling member provided on the output shaft for fitting engagement with an outer circumferential surface of the coupling member, and a locking device for locking the inspection coupler in position against movement relative to the inspection shaft when the inspection coupler is located in a predetermined inspecting position in which the inspection coupler is spaced a distance from the coupling member on the output shaft. The lock device of the position inspection jig may include a radial lock pin having opposite ends projecting radially outward from a circumferential surface of the inspection shaft, and a circular locking socket extending around one of the support holes for interlocking engagement with the lock pin, the locking socket having an oblong hole extending radially across the center of the circular locking socket to allow the lock pin to enter the locking socket. The locking device of the inspection coupler may include a radial locking hole formed in the end portion of the inspection shaft, and a locking knob having a threaded shank threaded in the inspection coupler and having a positioning pin formed at a front end of the threaded shank, the positioning pin being receivable in the radial locking hole of the inspection shaft.

In another preferred form of the invention, the position inspection jig further includes a lock device for locking the inspection shaft in position against axial movement relative to the inspection pump dummy. The inspection coupler has a cylindrical wall having an inside diameter slightly larger than an outside diameter of the coupling member provided on the output shaft for fitting engagement with an outer circumferential surface of the coupling member, and an axial position sensor disposed on the inspection coupler for detecting the arrival of the inspection coupler at a predetermined inspecting position in which the inspection coupler is spaced a distance from the coupling member on the output shaft. The axial position sensor may comprise a photosensor.

Preferably, the position inspection jig further includes at least three ultrasonic depth indicators provided on the cylindrical wall of the inspection coupler and spaced at equal angular intervals in a circumferential direction of the cylindrical wall for indicating the amount of an alignment error of the output shaft relative to the rotating shaft. The position inspection jig may further include an additional ultrasonic depth indicator provided on the inspection coupler for measuring an axial distance between the inspection coupler and the coupling member on the output shaft.

In a further preferred form of the invention, the position inspection jig further includes a lock device for locking the inspection shaft in position against axial movement relative to the inspection pump dummy. The inspection coupler has a cylindrical wall having an inside diameter slightly larger than an outside diameter of the coupling member provided on the output shaft for fitting engagement with an outer circumferential surface of the coupling member, and a visual position indicator for visually indicating the position of the inspection coupler relative to the inspection shaft to determine whether or not the coupling member on the output shaft is in a correct position relative to the coupling member on the rotating shaft when the inspection coupler is in abutment with the coupling member on the output shaft. The visual position indicator may comprise a rear end face of the inspection coupler forming a reference line of the position indicator, and three circumferential grooves formed in the end portion of the inspection shaft for forming graduates of the position indicator, the three circumferential grooves are spaced equidistantly and two of the three circumferential grooves that are disposed on opposite side of the remaining circumferential groove are spaced by a distance equal to a maximum allowable range of the axial position of the output shaft of the engine.

According to a second aspect of the present invention, there is provided a method of installing an engine in a hull of a small watercraft via four engine mounts in such a manner that an output shaft of the engine is in alignment with a rotating shaft of a propulsion unit of the watercraft. The method comprises the steps of: providing an engine positioning jig for positioning the engine mounts relative to the rotating shaft of the propulsion unit, the engine positioning jig having the same construction as described above with respect to the first aspect of the invention; fixedly mounting the engine lower part dummy on the engine mounts while the engine mounts are kept temporarily fastened to the hull in such a manner that the engine mounts are allowed to move in all of a vertical direction, a widthwise direction and a lengthwise direction of the watercraft to some extent; positioning the engine mounts in the vertical direction, widthwise direction and lengthwise direction, respectively, of the watercraft through displacements of the engine lower part dummy in the respective directions relative to the rotating shaft; then, firmly securing the engine mounts to the full; thereafter, removing the engine lower part dummy from the engine mounts; and finally, mounting the engine on the engine mounts to thereby install the engine in the hull of the watercraft.

The step of positioning the engine mounts is preferably achieved by: inserting a centering shaft through the front and rear through-holes of the engine lower part dummy while supporting the centering shaft in such a manner that the centering shaft assumes a position of the rotating shaft of the propulsion unit; determining an offset in the vertical direction of the center of each through-hole from an axis of the centering shaft; canceling out the offset to thereby achieve positioning of the engine mounts in the vertical direction of the watercraft; then, performing positioning of the engine mounts in the widthwise direction of the watercraft while the centering shaft is used as a reference for the widthwise positioning; and thereafter, performing positioning of the engine mounts in the lengthwise direction of the watercraft while the centering shaft is used as a reference for the lengthwise positioning.

In a preferred form of the invention, the front through-hole of the engine lower part dummy has an inside diameter smaller than an inside diameter of the rear through-hole, the engine lower part dummy further has a spring loaded locking device for interlocking engagement with a circumferential groove formed in the centering shaft. The centering shaft includes a first portion and a second portion coaxial with each other and adapted to be simultaneously received in the front and rear through-holes, respectively, such that a loose fit is formed between each of the through-holes and a corresponding one of the first and second shaft portions. The centering shaft further includes a third portion and a fourth portion coaxial with each other and adapted to be simultaneously received in the front and rear through-holes, respectively, such that a sliding fit is formed between each of the through-holes and a corresponding one of the third and fourth shaft portions. The third and fourth shaft portions are disposed behind the first and second shaft portions, respectively, when viewed in a direction of insertion of the centering shaft through the front and rear through-holes. The determining an offset is achieved by: advancing the centering shaft in the direction of insertion until the first and second shaft portions are loosely received in the front and rear through-holes, respectively; and measuring the thickness of a clearance formed between each of the first and second shaft portions and a corresponding one of the front and rear through-holes in the vertical direction. The performing positioning of the engine mount in the widthwise direction is achieved by: while the engine lower part dummy is being slightly displaced in the widthwise direction relative to the centering shaft, further advancing the centering shaft in the direction of insertion until the third and fourth shaft portions are slidably received in the front and rear through-holes, respectively. And, the performing positioning of the engine mounts in the lengthwise direction is carried out by: displacing the engine lower part dummy in an axial direction of the centering shaft until the spring-loaded locking device on the engine lower part dummy fits in the circumferential groove of the centering shaft.

In the foregoing method, the step of canceling out the offset is achieved by: selecting a shim having a thickness determined on the basis of a thickness of the measured clearance; and placing the shim between a respective engine mount and the hull of the watercraft. The measuring the thickness of a clearance is carried out by insetting a gauge block into the clearance, the gauge block having a series of steps on one side thereof, or alternatively, by activating an ultrasonic depth indicator provided on the skeleton frame adjacent each of the front and rear through-holes, the ultrasonic depth indicator being disposed in a vertical plane passing through the center of the respective through-hole.

For use with a watercraft having a propulsion unit composed of a jet pump mounted via a thrust plate to a vertical wall of the hull, and a pair of coupling members provided on the output shaft of the engine and an rotating shaft of the jet pump to join the output shaft and the rotating shaft, the method may further comprise the steps of: attaching an inspection pump dummy to the thrust plate, the inspection pump dummy being so shaped to resemble the jet pump and having a plurality of coaxial support holes aligned with a rotating shaft of the jet pump; then, inserting an inspection shaft through the support holes of the inspection pump dummy so that the inspection shaft is supported in a position to assume a position of the rotating shaft of the jet pump; and thereafter, performing an inspection of the output shaft for axial position and alignment error relative to the inspection shaft.

In one preferred form of the invention, the performing an inspection of the output shaft comprises: mounting an inspection coupler on a fore-end portion of the inspection shaft so that the inspection coupler is slidably movable along the inspection shaft in a direction toward and away from the coupler provided on the engine output shaft, the inspection coupler including a cylindrical wall having an inside diameter slightly larger than an outside diameter of the coupling member on the output shaft; then, displacing the inspection coupler along the inspection shaft until the inspection coupler is located in a predetermined inspecting position where the inspection coupler is spaced a distance from the coupling member on the output shaft in the axial direction of the inspection shaft; thereafter, measuring an axial space between the inspection coupler and the coupling member to thereby determine whether or not the output shaft is correctly positioned in the lengthwise direction of the watercraft; and subsequently, displacing the inspection coupler toward the coupling member on the output shaft to thereby determine whether or not the output shaft is in correct alignment with the rotating shaft of the jet pump depending on the occurrence of a fitting engagement between the cylindrical wall of the inspection coupler and the coupling member on the output shaft. It is preferable that, when the fitting engagement between the cylindrical wall of the inspection coupler and the coupling member on the output occurs, the amount of an alignment error is measured by at least three ultrasonic depth indicators provided on the cylindrical wall of the inspection coupler and spaced at equal intervals in a circumferential direction of the cylindrical wall.

In another preferred form of the invention, the performing an inspection of the output shaft comprises: mounting an inspection coupler on a fore-end portion of the inspection shaft so that the inspection coupler is slidably movable along the inspection shaft in a direction toward and away from the coupler provided on the engine output shaft, the inspection coupler including a cylindrical wall having an inside diameter slightly larger than an outside diameter of the coupling member on the output shaft; then, displacing the inspection coupler toward the coupling member on the output shaft to thereby determine whether or not the output shaft is in correct alignment with the rotating shaft of the jet pump depending on the occurrence of a fitting engagement between the cylindrical wall of the inspection coupler and the coupling member on the output shaft, further displacing the inspection coupler toward the coupling member until the inspection coupler is located in a predetermined inspecting position where the inspection coupler is spaced a distance from the coupling member on the output shaft in the axial direction of the inspection shaft; and thereafter, measuring an axial space between the inspection coupler and the coupling member to thereby determine whether or not the output shaft is correctly positioned in the lengthwise direction of the watercraft. The axial space between the inspection coupler and the coupling member may be measured by an ultrasonic depth indicator provided on the inspection coupler.

In a still further preferable form of the invention, the performing an inspection of the output shaft comprises: mounting an inspection coupler on a fore-end portion of the inspection shaft so that the inspection coupler is slidably movable along the inspection shaft in a direction toward and away from the coupler provided on the engine output shaft, the inspection coupler including a cylindrical wall having an inside diameter slightly larger than an outside diameter of the coupling member on the output shaft and a rear end surface serving as a reference line of a visual axial position indicator, and the inspection shaft having three circumferential grooves spaced equidistantly with two outer grooves spaced by a distance equal to a maximum allowable range of the axial position of the output shaft; then, displacing the inspection coupler toward the coupling member on the output shaft to thereby determine whether or not the output shaft is in correct alignment with the rotating shaft of the jet pump depending on the occurrence of a fitting engagement between the cylindrical wall of the inspection coupler and the coupling member on the output shaft, further displacing the inspection coupler toward the coupling member until the inspection coupler abuts on the coupling member; and thereafter, checking the position of the rear end face of the inspection coupler relative to the circumferential grooves of the inspection shaft to thereby determine whether or not the output shaft is correctly positioned in the lengthwise direction of the watercraft.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

Figure 1:
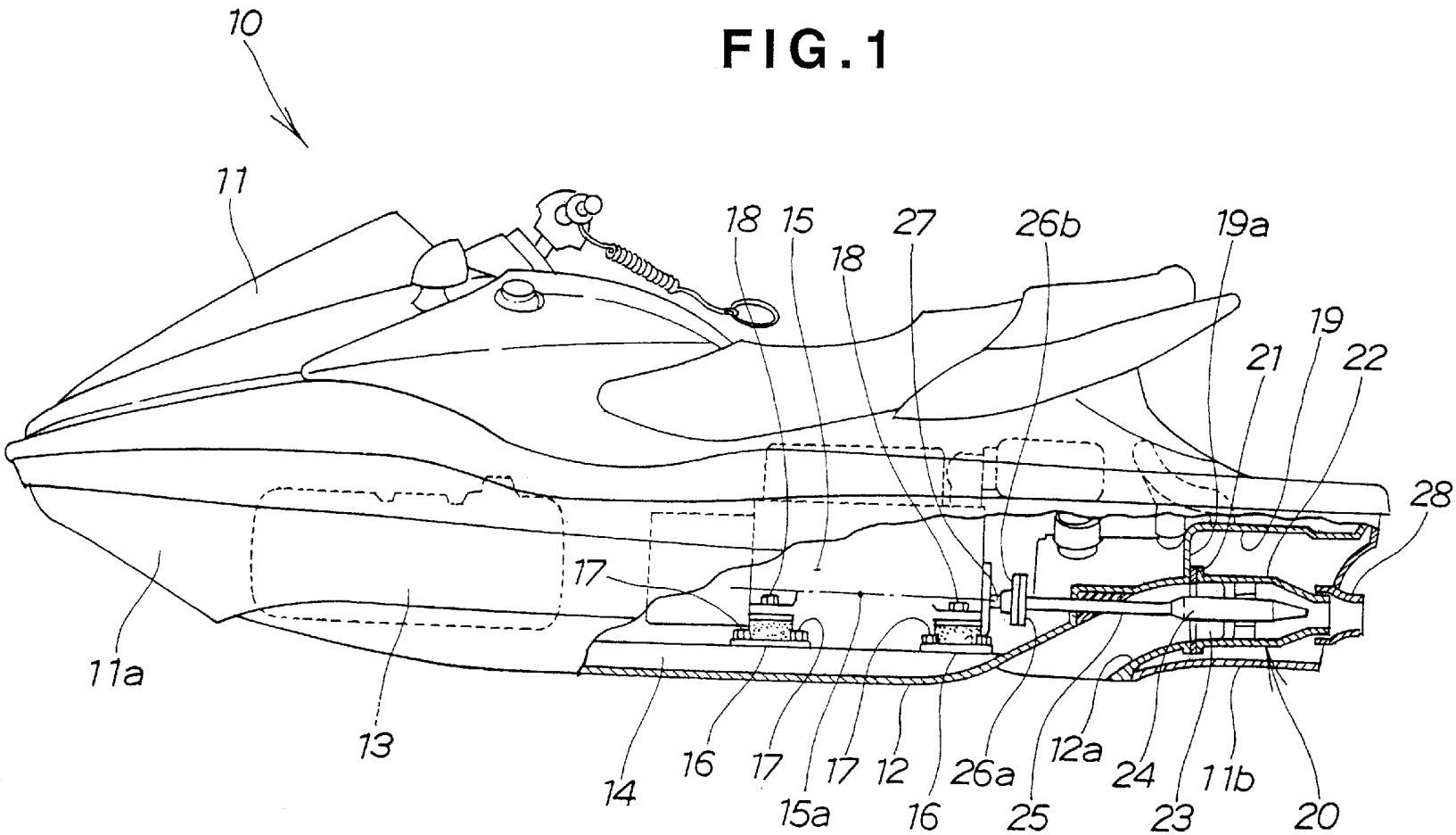
FIG. 1 is a side view, with parts cut-away for clarity, of a small planing watercraft including an engine which has been installed by using an engine alignment jig assembly according to the present invention.

Referring now to the drawings and FIG. 1 in particular, there is shown a small planing watercraft 10 having an engine 15 installed in a hull 11 with the aid of an engine alignment jig assembly according to a first embodiment of the present invention. The small planing watercraft 10 takes the form of a jet propulsion boat and includes a fuel tank 13 disposed on a front part 11*a* of the hull 11 near a bow, the engine 15 disposed on a rear side of the fuel tank 12, and a jet pump chamber 19 provided at a rear part 11*b* of the hull 11 near a stern. A jet pump 20 is disposed in the jet pump chamber 19 as a drive or propulsion unit.

The jet pump 20 includes a thrust plate 21 attached to a vertical wall 19*a* of the jet pump chamber 19, a hollow cylindrical stator 22 attached to the thrust plate 21 so that the axis of the stator 22 extends horizontally, and an impeller 23 rotatably disposed inside the stator 22. The impeller 23 has a central rotating shaft 24 spline-connected to a drive axle or shaft 25. The drive shaft 25 has a front end equipped with a coupling member 26*a*. The engine 15 has an output shaft (crankshaft) 27 having a rear end (outer end) equipped with a coupling member 26*b*. The coupling members 26*a* and 26*b* are coupled together to join the drive shaft 25 and the engine output shaft 27. It may be considered that the drive shaft 25 spline-connected to the rotating shaft 24 of the jet pump 20 forms a part of the rotating shaft 24.

With this arrangement, while the engine 15 is running, rotation of the output shaft 27 is transmitted through the drive shaft 25 to the impeller 23. Rotation of the impeller 23 causes water to be sucked or pumped up from a suction hole 12*a* formed at a bottom 12 of the hull 11 and subsequently ejected backward from a steering nozzle 28 in the form of a pressurized stream of water (water jet). By a reaction of the water jet ejected backward from the steering nozzle 28, the jet propulsion boat 10 propels in a forward direction.

For installation of the engine 15, four engine mounts 16 (two being shown) are attached by bolts 17 to a bottom part 14 of the hull 11. Then, the engine 15 is attached by bolts 18 to the engine mounts 16. During the engine installing operation, an engine alignment jig assembly generally designated by 30 such as shown in FIG. 2 is used.

Figure 2:
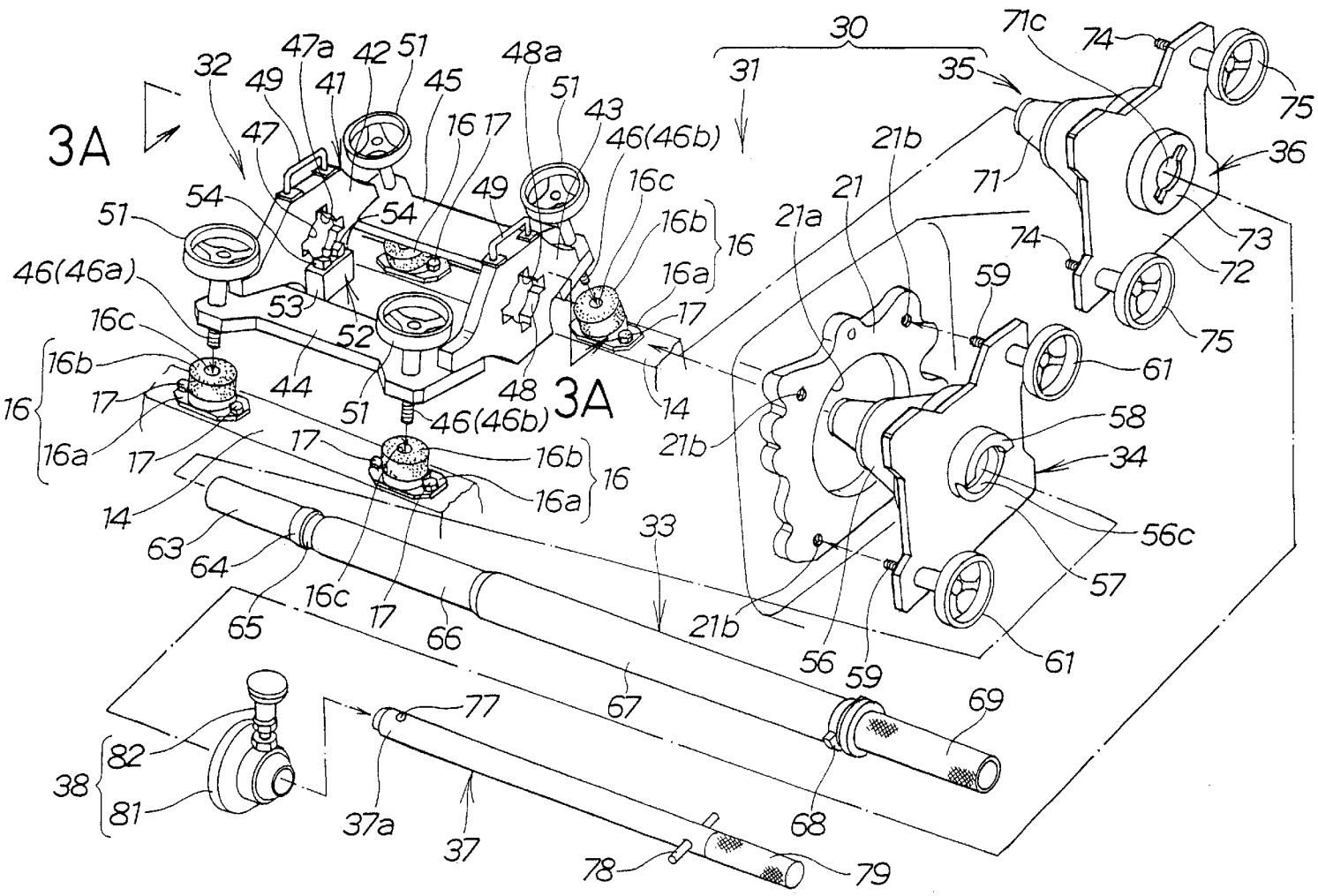
FIG. 2 is an exploded perspective view of an engine alignment jig assembly according to a first embodiment of the present invention.

As shown in FIG. 2, the engine alignment jig assembly 30 generally comprises an engine positioning jig 31 used for positioning the engine 15 (FIG. 1) at a correct position, and a position inspection jig 35 used for inspecting the position of the engine 15 which has been mounted on the engine mounts 16 positioned by using the engine positioning jig 31.

The engine positioning jig 31 is composed of an engine lower part dummy 32 for positioning the engine mounts 16, a centering shaft 33 for positioning the engine lower part dummy 32, and a pump dummy 34 adapted to be mounted to the thrust plate 21 for supporting the centering shaft 33.

The position inspection jig 35 is composed of an inspection pump dummy 36 adapted to be attached to the thrust plate 21, an inspection shaft 37 adapted to be supported by the inspection pump dummy 36, and an inspection coupler 38 adapted to be mounted on a fore-end (left end in FIG. 2) of the inspection shaft 37.

The engine mounts 16 each include a generally rectangular flat plate 16*a* and a cylindrical rubber body 16*b* formed integrally with each other. The rubber mount body 16*b* has a central axial threaded hole 16*c*, and the plate 16*a* has two mount holes 16*d* disposed on opposite sides of the cylindrical rubber mount body 16*b* in such a manner that the mount holes 16*d* and the thread hole 16*c* are located on a single straight line. Each engine mount 16 is firmly attached by two screws 17 to the bottom part 14 of the hull 11. The screws 17 extend through the mount holes 16*d* of the plate 16*a* and they are threaded into the bottom part 14 of the hull 11. The mount holes 16*d* of each plate 16*a* have an inside diameter larger than an outside diameter of the screws 17 to such an extent that, during adjustment, each engine mount 16 is allowed to move in all directions in a horizontal plane with respect to the screw 17.

Figure 4A:
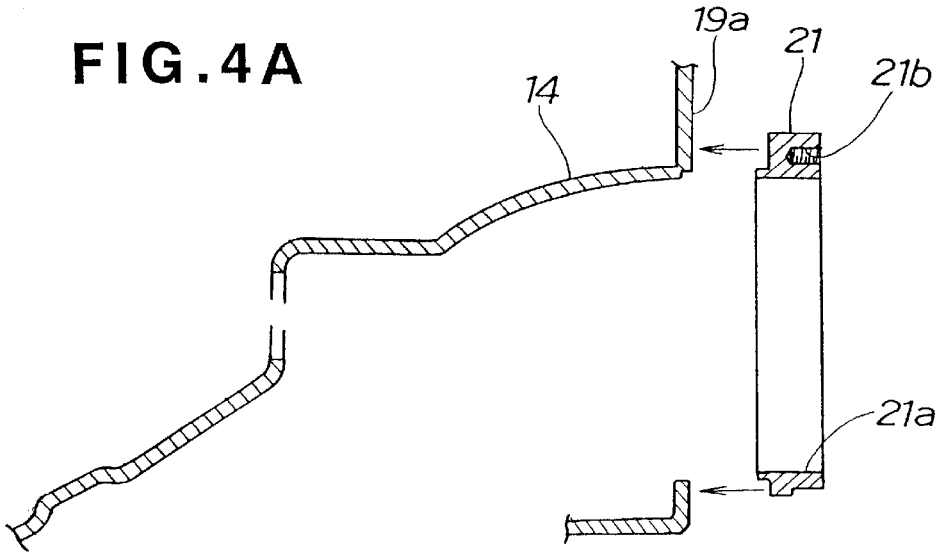
Figure 4B:
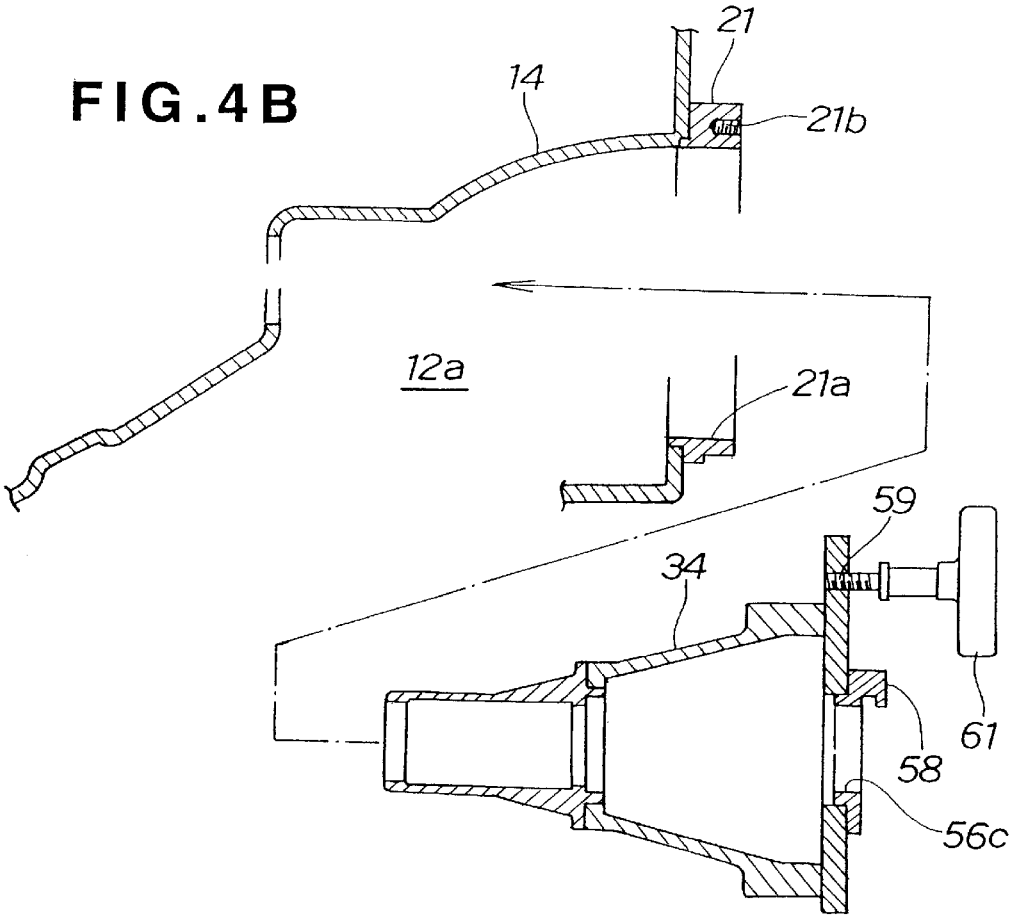

The thrust plate 21 is generally rectangular in shape and has a central circular hole or opening 21*a* for the passage therethrough of the impeller 23 (FIG. 1). A plurality of threaded mount holes 21*b* are formed in a peripheral portion of the thrust plate 21 at regular intervals in the circumferential direction for enabling the stator 22 to be attached to the thrust plate 21. The threaded mount holes 21*b* are blind holes, as shown in FIGS. 4A and 4B.

The engine lower part dummy 32, which forms a part of the engine positioning jig 31, is constructed to resemble a lower half of the real engine 15 (FIG. 1) of the small planing watercraft 10. The engine lower part dummy 32 includes a generally rectangular skeleton frame 41 having substantially the same size in plan view (i.e., length and breadth) as the engine lower half, four screws 46 each provided at one of four corners of the rectangular skeleton frame 41 for being threaded in the corresponding engine mount 16, a front circular through-hole 47 formed in the skeleton frame 41 with its center aligned with the axis 15*a* of the output shaft 27 (FIG. 1) of the engine 15, a rear circular through-hole 48 formed in the skeleton frame 41 with its center aligned with the axis 15*a* of the engine output shaft 27, and a pair of spaced grip handles 49, 49 provided on the skeleton frame 41 for handling of the engine lower part dummy 32. The front circular through-hole 47 is disposed centrally between two 46*a*, 46*a* of the four screws 46 that are located on the bow side of the watercraft 10, and the rear circular through-hole 48 is disposed centrally between the remaining two screws 46*b*, 46*b* (hereinafter referred to as "rear screws") that are located on the stern side of the watercraft 10. The screws 46*a* are hereinafter referred to as "front screws", and the screws 46*b* are hereinafter referred to as "rear screws". The rear circular through-hole 48 has an inside diameter larger than that of the front circular through-hole 47.

It will be appreciated that the engine lower part dummy 32 formed essentially by the skeleton frame 41 is much lighter than the real engine 15 and the operator can handle the engine lower part dummy easily without requiring undue muscular effort. The skeleton frame 41 is composed of front and rear frame members 42 and 43 of generally diamond-shaped configuration spaced in a front-and-rear direction (lengthwise direction) of the watercraft 10, a left side frame member 44 interconnecting the respective left ends of the front and rear frame members 42, 43, and a right side frame member 45 interconnecting the respective right ends of the front and rear frame members 42, 43. The skeleton frame 41 thus constructed has a generally rectangular shape as viewed in the plan.

Each front screw 46*a* is rotatably mounted on a front end portion of a respective one of the left and right side frame members 44, 45, and each rear screw 46*b* is rotatably mounted on a rear end portion of a respective one of the left and right side frame members 44, 45. The screws 46*a*, 46*b* each have an enlarged head shaped into a circular handle 51. By rotating the handle 51 in a tightening direction (usually in the clockwise direction), the screw 46 (46*a*, 46*b*) is threaded into the threaded hole 16*c* of each rubber mount body 16*b* thereby to mount the engine lower part dummy 32 onto the engine mounts 16. When the engine lower part dummy 32 is to be detached from engine mounts 16, the handle 51 of each screw 46 (46*a*, 46*b*) is rotated in a loosening direction (usually in the counterclockwise direction) until the screw 46 (46*a*, 46*b*) is removed from the threaded hole 16*c* of the corresponding rubber mount body 16*b*. The grip handles 49 are provided on respective upper ends of the front and rear frame members 42, 43 so as to facilitate easy handling of the engine lower part dummy 32 during attachment and detachment of the dummy 32 with respect to the engine mounts 16.

The front circular through-hole 47 is formed in the front frame member 42. The front frame member 42 also has a cross-shaped radial groove 47*a* formed in a circumferential wall defining the front circular through-hole 47. The cross-shaped radial groove 47*a* has two mutually perpendicular groove parts, one groove part being in a vertical plane and the other groove part being in a horizontal plane. The front frame member 42 has a lock means or device 52 disposed below the through-hole 47. The lock device 52 includes a rectangular hollow case 53 having an upper end open, and a pair of laterally spaced locking prongs 54, 54 projecting from the open upper end of the case 53 for interlocking engagement with a circumferential groove 65 in the centering shaft 33 to lock the engine lower part dummy 32 in a correct position with respect to the lengthwise direction of the watercraft 10. The structure of the lock device 53 will be described in greater detail with reference to FIGS. 10 and 11.

Figure 5:
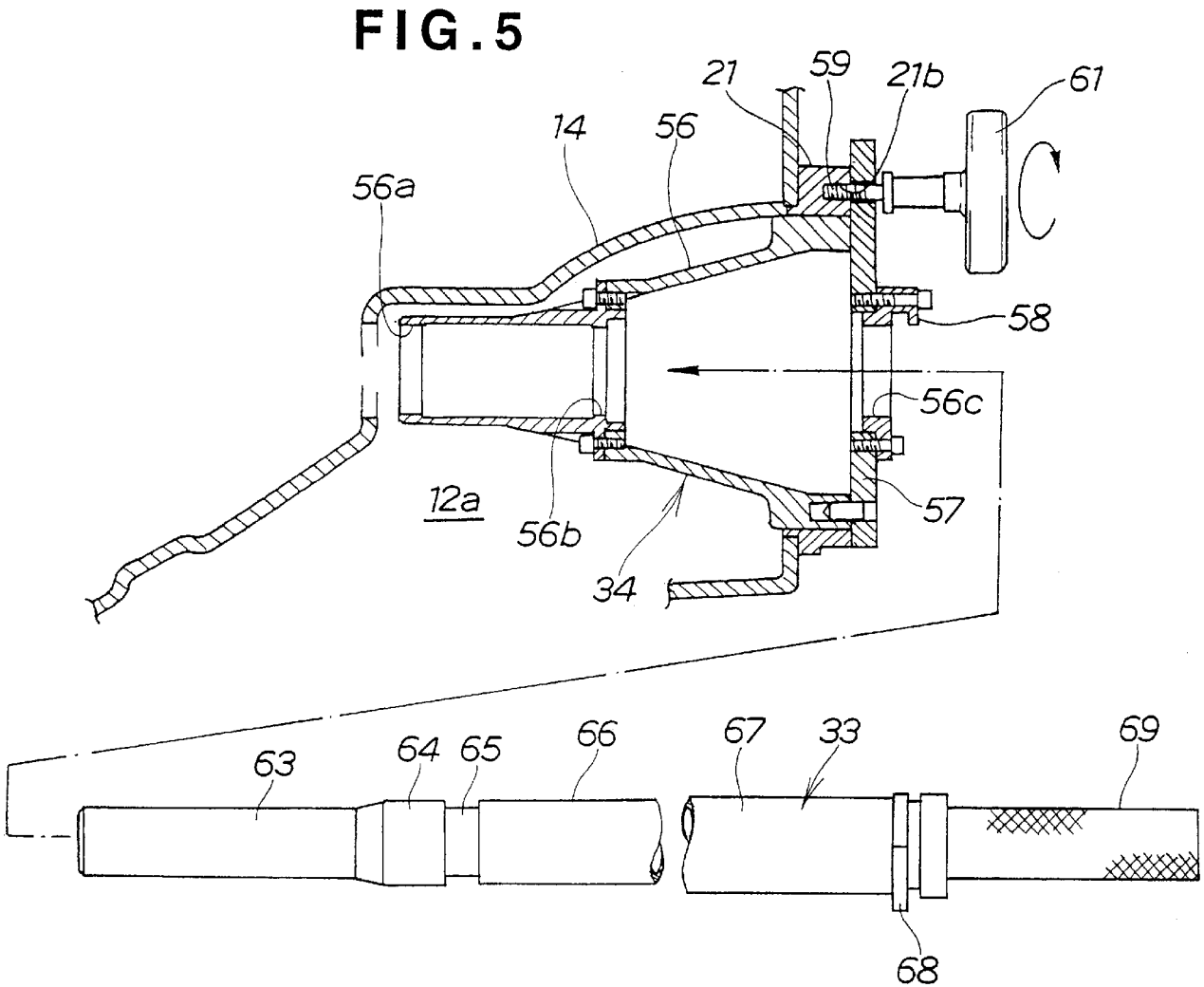

The pump dummy 34, which forms a part of the engine positioning jig 31, includes a generally conical hollow body 56 having a small-diameter front end and a large-diameter rear end, and a generally rectangular end plate 57 firmly connected to the rear end of the conical hollow body 56. The end plate 57 has a central hole 56*c* coaxial with the conical hollow body 56 for insertion therethrough of the centering shaft 33, a locking member shaped into a semicircular locking projection 58 extending along a part of the perimeter of the central hole 57 for locking engagement with a part (described later) of the centering shaft 33, and two screws 59 rotatably mounted on two diagonally opposite corner parts of the rectangular end plate 57 for threading engagement with two of the threaded mount holes 21*b* of the thrust plate 21. The conical hollow body 56 of the pump dummy 34 has a maximum diameter smaller than the diameter of the central opening 21*a* of the thrust plate 21 so that the body 56 can be inserted into the opening 21*a*. As shown in FIG. 5, the pump dummy 34 has a first support hole 56*a* formed at the small-diameter front end portion of the conical hollow body 56, a second support hole 56*b* formed at a longitudinal central portion of the hollow body 56, and a third support hole 56*c* formed by the central hole of the end plate 57. These support holes 56*a*, 56*b* and 56*c* are coaxial with each other and have the same inside diameter.

The screws 59 each have an enlarged head shaped into a circular handle 61. By rotating the handle 61 in a tightening direction (usually in the clockwise direction), the screw 59 is threaded into the corresponding threaded hole 21*b* of the thrust plate 21 thereby to attach the pump dummy 34 to the thrust plate 21. When the pump dummy 34 is to be detached from thrust plate 21, the handle 61 of each screw 59 is rotated in a loosening direction (usually in the counterclockwise direction) until the screw 59 is removed from the mating threaded mount hole 21*b* of the thrust plate 21.

The centering shaft 33, which forms a part of the engine positioning jig 31, has a hollow structure and includes a small-diameter end portion 63, a short first large-diameter portion 64, the circular groove 65, a second large-diameter portion 66, a third large-diameter portion 67, a semicircular flange 68 and a hand grip 69 that are arranged in the order named in a direction from a fore-end (left end in FIG. 2) to a rear end of the centering shaft 63. The circumferential groove 65 is lockingly receptive of the locking prongs 54 of the lock device 52, as described above. The semicircular flange 68 is lockingly engageable with the semicircular locking projection 58 of the pump dummy 34. The handgrip 69 is serrated so that the operator can grip the handgrip 69 stably and reliably.

The first large-diameter portion 64 of the centering shaft 33 has an outside diameter larger than that of the small-diameter end portion 63. The first and second large-diameter portions 64 and 66 have the same outside diameter. The third large-diameter portion 67 has a larger outside diameter than the first and second large-diameter portions 64, 66. The outside diameter of the small-diameter portion 63 is smaller than the inside diameter of the front through-hole 47 of the engine lower part dummy 32 to such an extent that a loose fit is formed between the small-diameter portion 63 and the front through-hole 47. The loose fit forms enough clearance to allow insertion of a gauge block (described later) even when a vertical offset occurs between the front through-hole 47 and an axis of the small-diameter portion 63. The outside diameter of the first larger-diameter portion 64 is slightly smaller than the inside diameter of the front through-hole 47 of the engine lower part dummy 32 so that a sliding fit is formed between the first larger-diameter portion 64 and the front through-hole 47. The outside diameter of the second large-diameter portion 66 is smaller than the inside diameter of the rear through-hole 48 of the engine lower part dummy 32 to such an extent that a loose fit is formed between the second large-diameter portion 66 and the rear through-hole 48. The loose fit forms enough clearance to allow insertion of the gauge block even when a vertical offset occurs between the rear through-hole 48 and an axis of the second large-diameter portion 66. The outside diameter of the third larger-diameter portion 67 is slightly smaller than the inside diameters of the rear through-hole 48 of the engine lower part dummy 32 and of the first to third support holes 56*a*–56*c* of the pump dummy 34 so that a sliding fit is formed between the third larger-diameter portion 67 and the rear through-hole 48 and also between the third large-diameter portion 67 and the support holes 56*a*–56*c*.

The inspection pump dummy 36, which forms a part of the position inspection jig 35, includes a generally conical hollow body 71 having a small-diameter front end and a large-diameter rear end, and a generally rectangular end plate 72 firmly connected to the rear end of the conical hollow body 71. The end plate 72 has a central hole 71*c* coaxial with the conical hollow body 71 for insertion therethrough of the inspection shaft 37, a locking member shaped into a circular locking socket 73 extending around the central hole 71*c* for locking engagement with a part (described later) of the inspection shaft 37, and two screws 74 rotatably mounted on two diagonally opposite corner parts of the rectangular end plate 72 for threaded engagement with two of the threaded mount holes 21*b* of the thrust plate 21. The conical hollow body 71 of the inspection pump dummy 36 has a maximum diameter smaller than the diameter of the central opening 21*a* of the thrust plate 21 so that the body 71 can be inserted into the opening 21*a*.

Figure 16:
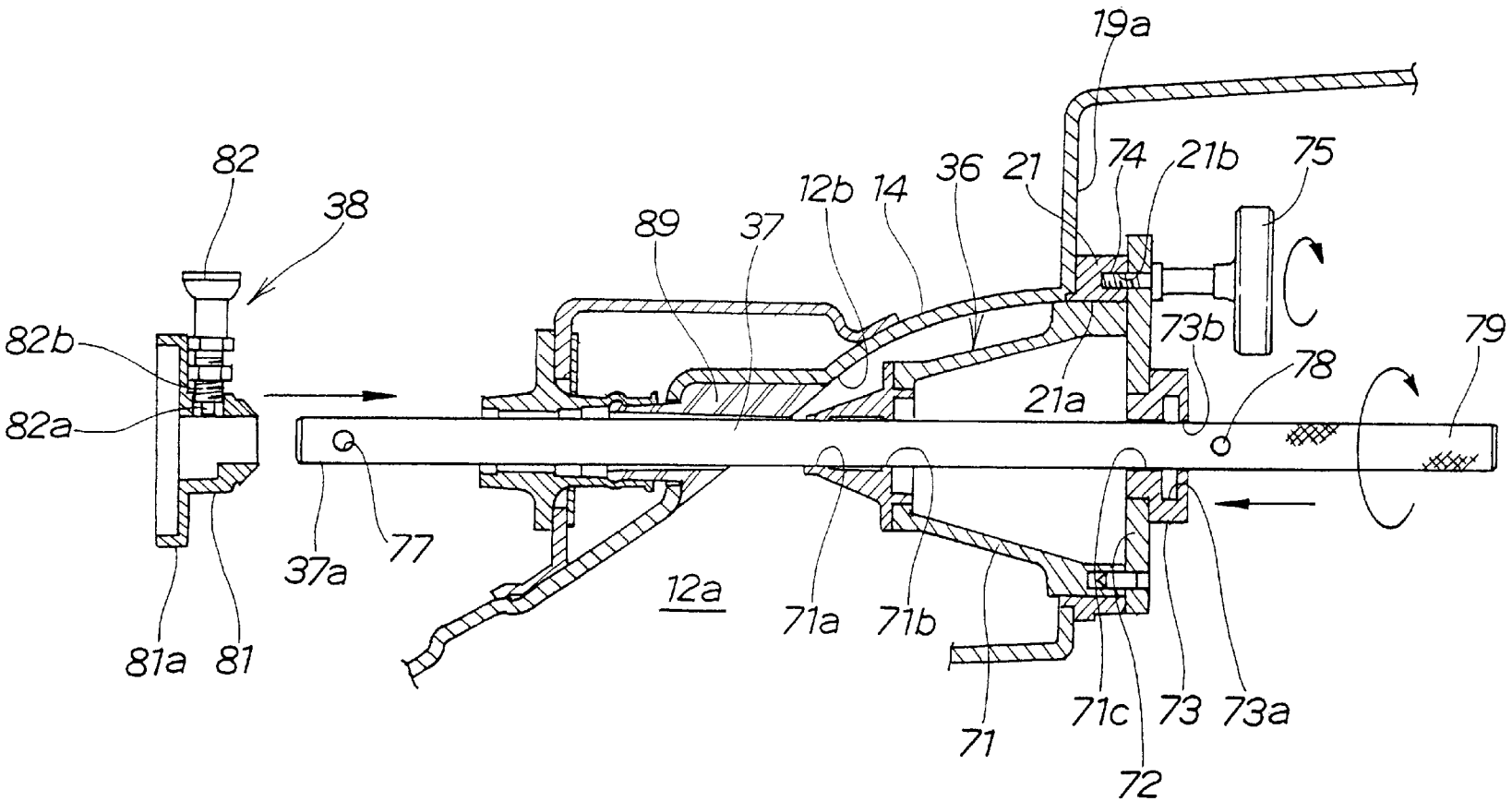
FIGS. 16, 17, 18 and 19A–19B are views illustrative of the manner in which the position of an output shaft of the engine is inspected by using a position inspection jig of the engine alignment jig assembly.

The screws 74 each have an enlarged head shaped into a circular handle 75. By rotating the handle 75 in a tightening direction (usually in the clockwise direction), the screw 74 is threaded into the corresponding threaded hole 21*b* of the thrust plate 21 thereby to attach the inspection pump dummy 36 to the thrust plate 21. When the inspection pump dummy 36 is to be detached from thrust plate 21, the handle 75 of each screw 74 is rotated in a loosening direction (usually in the counterclockwise direction) until the screw 74 is removed from the mating threaded mount hole 21*b* of the thrust plate 21. As shown in FIG. 16, the inspection pump dummy 36 has a first support hole 71*a* formed at the small-diameter front end portion of the conical hollow body 71, a second support hole 71*b* formed at the small-diameter front end portion of the conical hollow body 71 behind the first support hole 71*a*, and a third support hole 71*c* formed by the central hole of the end plate 72. These support holes 71*a*, 71*b* and 71*c* are coaxial with each other and have the same inside diameter which is slightly larger than the outside diameter of the inspection shaft 37.

The inspection shaft 37, which forms a part of the position inspection jig 35, has a radial locking hole 77 at a fore-end portion 37*a* for receiving therein a part of the inspection coupler 38 to lock the inspection coupler 38 in position on the inspection shaft 37, a radial lock pin 78 having opposite ends projecting radially outward from a circumferential surface of the inspection shaft 37 for locking engagement with the circular locking socket (locking member) 73 of the inspection pump dummy 36, and a hand grip 79 at a rear end portion of the inspection shaft 37. The handgrip 79 is serrated so that the operator can grip the handgrip 79 stably and reliably.

The inspection coupler 38, which forms a part of the position inspection jig 35, includes a disc-like coupler body 81 adapted to be mounted on the fore-end portion 37*a* of the inspection shaft 37, and a locking knob 82 associated with the coupler body 81 so as to lock the inspection coupler 38 in position against movement relative to the inspection shaft 37.

The engine alignment jig assembly 30 of the foregoing construction operates as follows. For purposes of illustration, description will be first given to the operation of the engine positioning jig 31 with reference to FIGS. 3A through 14.

Figure 3A:
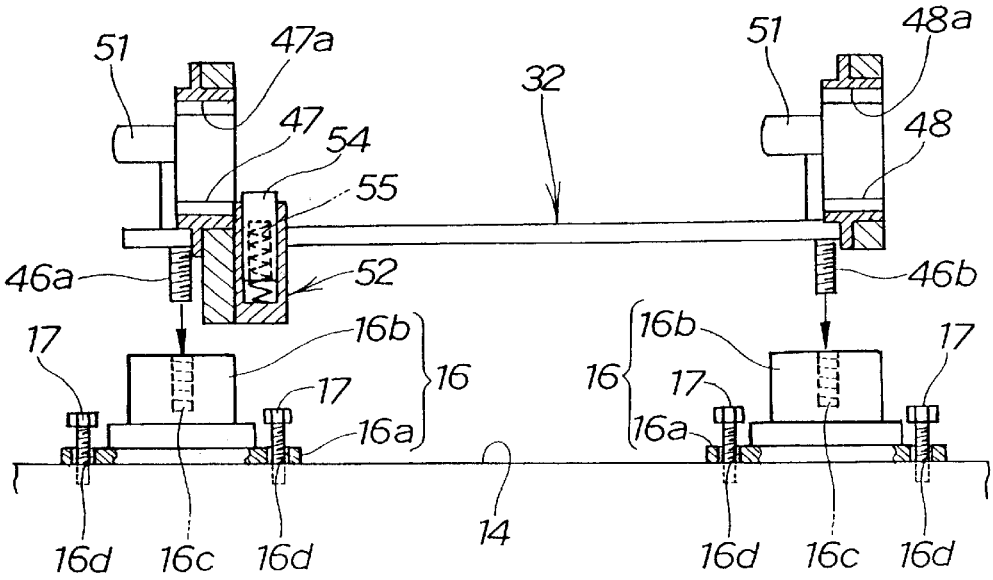
FIGS. 3A–3B, 4A–4B, 5, 6–7, 8–9, 10–11, 12 and 13A–13B are views illustrative of the manner in which engine mounts are positioned by using an engine positioning jig of the engine alignment jig assembly for installation of an engine.

As shown in FIG. 3A (a cross section taken along line 3A—3A of FIG. 2), the four engine mounts 16 (two being shown) are placed in respective predetermined positions on the bottom part 14 of the hull, and two screws 17 are threaded through the mount holes 16*d* of the plate 16*a* of each engine mount 16 into the hull bottom part 14 to such an extent that a head of each screw 17 is spaced upward from the plate 16*a* to allow vertical movement of the engine mount 16. Additionally, since the mount holes 16*a* have a larger diameter than the screws 17, the plate 16*a* is also allowed to move in a horizontal direction (particularly, in the front-and-rear direction and the left-and-right direction of the engine 15 shown in FIG. 1) relative to the screws 17.

Figure 3B:
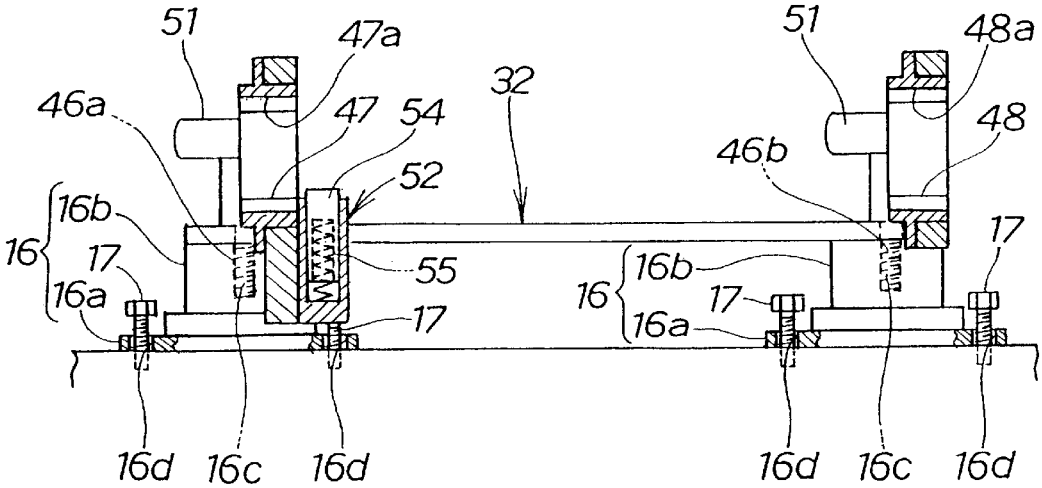

Then, the engine lower part dummy 32 is placed on the engine mounts 16, as indicated by the arrows shown in FIG. 3, and the front and rear screws 46*a* and 46*b* are threaded into the threaded holes 16*c* of the respective rubber mount bodies 16*b*. By rotating the handles 51 in the tightening direction, the screws 46*a*, 46*b* are tightly fastened to the rubber mount bodies 16*b* with the result that the engine lower part dummy 32 is fixedly mounted on the engine mounts 16, as shown in FIG. 3B. In this instance, the screws 17 remain in their original position of FIG. 3A in which the head of each screw 17 is vertically spaced from the plate 16*a* of the engine mount 16. The engine lower part dummy 32 can be readily mounted on the engine mounts 16 in a relatively short time because the weight of the engine lower part dummy 32 is very much smaller than that of the real engine 15 (FIG. 1).

Subsequently, the thrust plate 21 is attached by screws (not shown) to the vertical wall portion 19*a* of the jet pump chamber 19, as shown in FIGS. 4A and 4B. The pump dummy 34 is then inserted from the central opening 21*a* of the thrust plate 21 into the suction hole 12*a* formed at the bottom 12 of the hull 11 (FIG. 1), as indicated by the dash-and-dot line shown in FIG. 4B.

Figure 6:
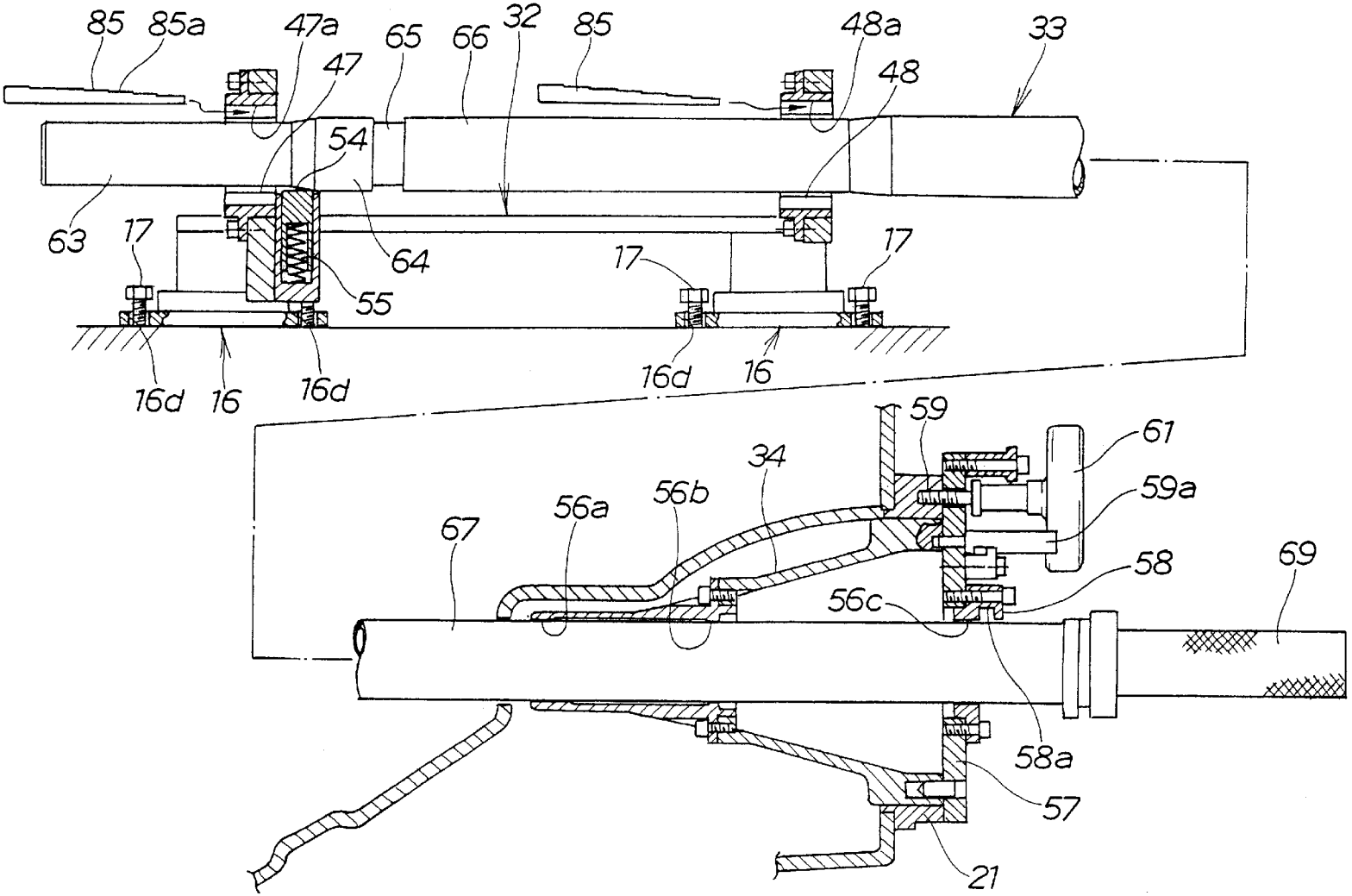

Thereafter, by rotating the handle 61 of each screw 59 in the tightening direction, the screw 59 is threaded into the corresponding threaded mount hole 21*b* of the thrust plate 21. The pump dummy 34 is thus attached to the thrust plate 21, as shown in FIG. 5. In this condition, the first, second and third support holes 56*a*, 56*b* and 56*c* are disposed in a position coaxial with the rotating shaft 24 (FIG. 1) of the impeller 23. Then, the centering shaft 33 is inserted into the pump dummy 34, as indicated by the dash-and-dot line shown in FIG. 5. In order to improve the positioning accuracy of the pump dummy 34 with respect to the thrust plate 21, it is possible to use a knock pin 59*a* such as shown in FIG. 6. The knock pin 59*a* is provided on the end plate 57 of the pump dummy 34 in such a manner that the knock pin 59*a* is removably receivable in a positioning hole (not designated) formed in the thrust plate 21. When the knock pin 59*a* is fitted in the positioning hole in the thrust plate 21, two diagonally opposed threaded mount holes 21*b* (FIG. 5) of the thrust plate 21 and the two screws 59 on the pump dummy 34 are in correct alignment with each other.

FIG. 6 shows a first stage of insertion of the centering shaft 33 relative to the other parts (i.e., the engine lower part dummy 32 and the pump dummy 34) of the engine positioning jig 31. At this insertion stage, the small-diameter portion 63 and second large-diameter portion 66 of the centering shaft 33 are loosely received in the front and rear circular through-holes 47, 48, respectively, of the engine lower part dummy 32. At the same time, the third large-diameter portion 67 of the centering shaft 33 is slidably fitted in the first, second and third support holes 56*a*, 56*b* and 56*c* of the pump dummy 34. Since the support holes 56*a*–56*c* are disposed coaxially with the rotating shaft 24 (FIG. 1) of the impeller 23 as described above, the centering shaft 33 can be placed in a position coaxial with the rotating shaft 24 of the impeller 23 merely by inserting the centering shaft 33 into the support holes 56*a*–56*c* of the pump dummy 34. The centering shaft 33, as it is slidably supported by the supporting holes 56*a*–56*b*, assumes the position of the rotating shaft 24 of the impeller 23.

The front and rear central through-holes 47, 48 of the engine lower part dummy 32 have a common axis assuming the position of the axis 15*a* (FIG. 1) of the engine output shaft (crankshaft) 27. As previously described, the diameter of the front circular through-hole 47 is larger than the outside diameter of the small-diameter portion 63 of the centering shaft 33 to such an extent that a loose fit is formed with a play between the front through-hole 47 and the small-diameter portion 63. Similarly, the diameter of the rear circular through-hole 48 is larger than the outside diameter of the second large-diameter portion 66 of the centering shaft 33 to such an extent that a loose fit is formed with a play between the rear through-hole 48 and the second large-diameter portion 66. Thus, at the first insertion stage shown in FIG. 6, an annular space is defined between the peripheral surface of the front through-hole 47 and the peripheral surface of the small-diameter portion 63 of the centering shaft 33 and also between the peripheral surface of the rear through-hole 48 and the peripheral surface of the second large-diameter portion 66 of the centering shaft 33.

In this condition, a gauge block 85 having a series of steps formed on one side (upper surface in FIG. 6) thereof is inserted in an upper section of the vertical part of the cross-shaped radial groove 47*a* of the front circular through-hole 47 until advancing movement of the gauge block 85 is stopped due to engagement of one step (85*a*, for example) on the gauge block 85 with the peripheral surface of the front through-hole 47. Then, the gauge block 85 is removed from the upper section of the vertical part of the cross-shaped radial groove 47*a*. Based on a thickness of the gauge block 85 as allotted at the step 85*a*, a vertical offset of the front through-hole 47 with respect to the axis of the centering shaft 33 can be determined. The vertical offset of the front through-hole 47 is hereinafter referred to as "front vertical offset". Thereafter, the gauge block 85 is also inserted in an upper section of the vertical part of the cross-shaped radial groove 48*a* of the rear circular through-hole 48, and a vertical offset of the rear through-hole 48 with respect to the axis of the centering shaft 33 can be determined in the same manner as described above. The vertical offset of the rear through-hole 48 is hereinafter referred to as "rear vertical offset".

Figure 7:
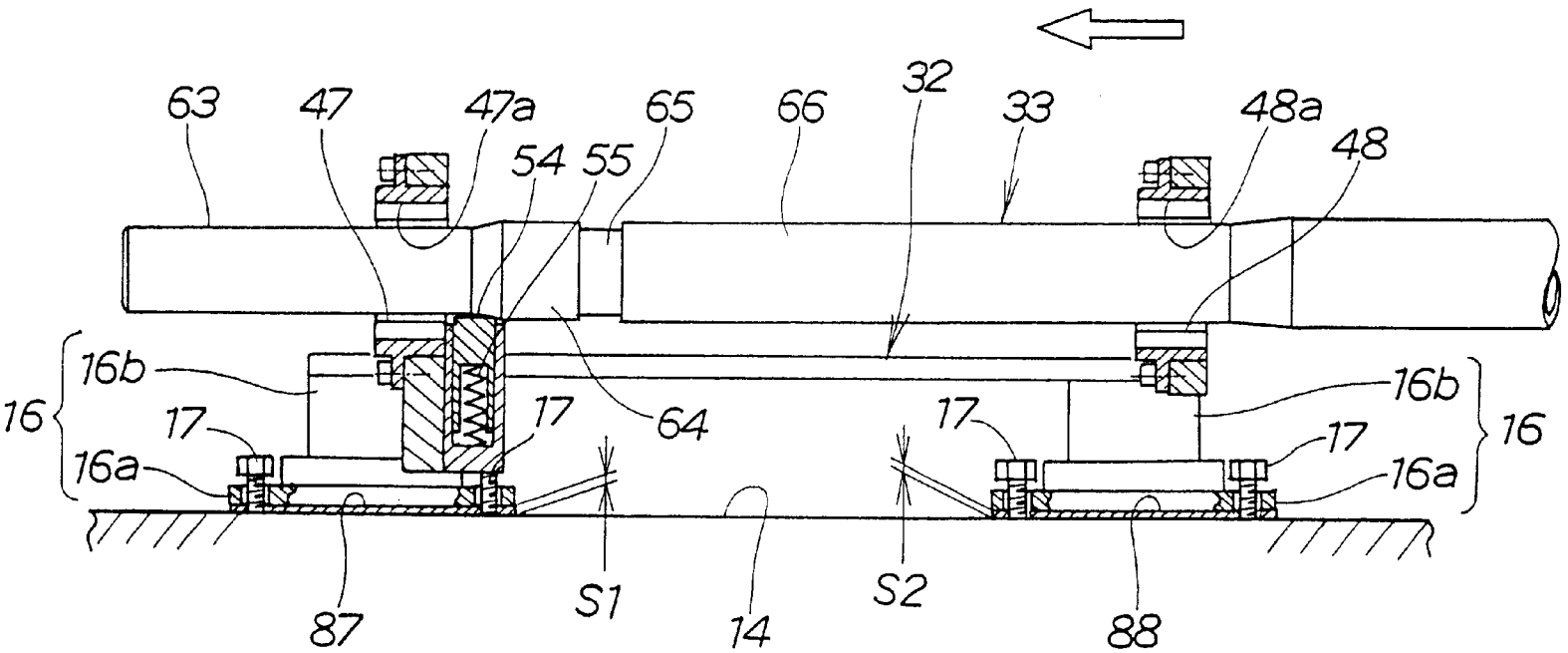

To cancel out the front vertical offset, a spacer or shim 87 having a thickness S1 equal to the front vertical offset is selected. The shim 87 is then placed between the bottom part 14 of the hull and the plate 16*a* of each of the two front engine mounts 16, as shown in FIG. 7. During insertion of the shim 87 between the plate 16*a* and the hull bottom part 14, the engine mount 16 and the engine lower part dummy 32 are lifted upward. Similarly, another spacer or shim 88 having a thickness S2 equal to the rear vertical offset is selected and then placed between the bottom part 14 of the hull and the plate 16*a* of each of the two rear engine mounts 16 so as to cancel out the rear vertical offset of the rear through-hole 48. Positioning of the engine mounts 16 in the vertical direction is thus completed.

Then, the centering shaft 33 is forced toward the fore-end or bow side of the watercraft (i.e., in the leftward direction indicated by the profiled arrow shown in FIG. 6) during which time the engine lower part dummy 32 is slightly displaced in a lateral or widthwise direction in the horizontal plane. In this instance, since the engine lower part dummy 32 is much smaller in weight than the real engine 15 (FIG. 1), widthwise displacement of the engine lower part dummy 32 can be achieved easily and smoothly. The reason why the engine lower part dummy 32 is slightly displaced in the widthwise direction will be discussed later with reference to FIG. 10.

Figure 8:
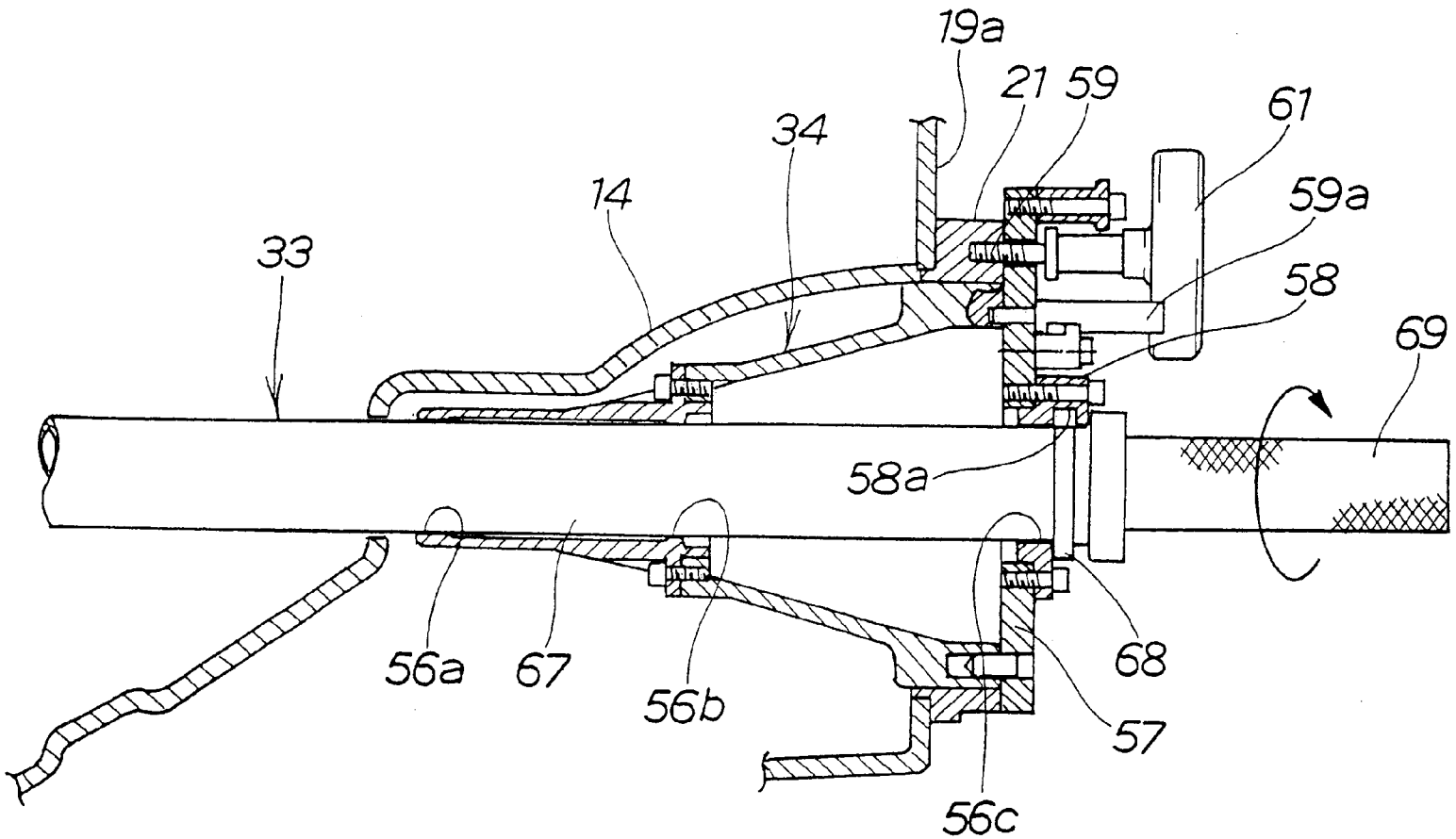
Figure 9:
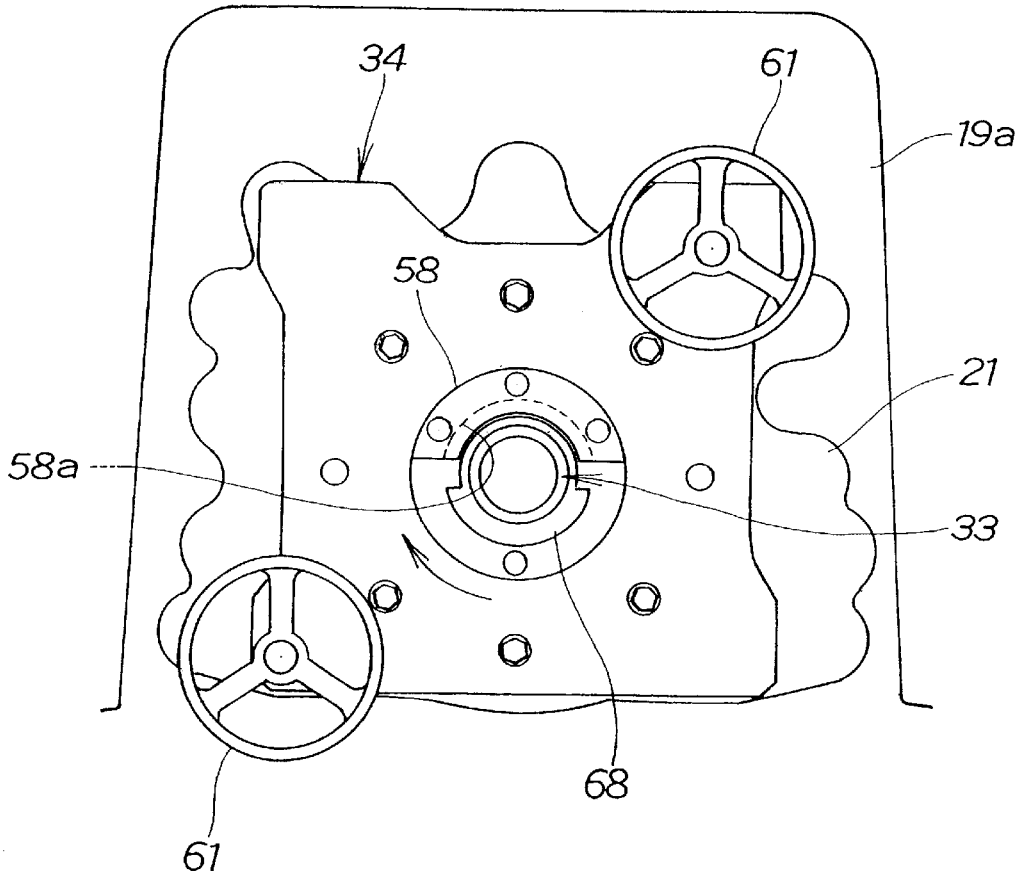

The leftward movement of the centering shaft 33 is terminated when the semicircular flange 68 comes in abutment with an outer surface of the end plate 57, as shown in FIG. 8. In this condition, the semicircular flange 68 lies in the same plane as a circumferential locking groove 58*a* formed in the semicircular locking projection 58 in concentric relation to the third support hole 56*c* of the pump dummy 34. The diameter of the locking groove 58*a* is slightly larger than the outside diameter of the semicircular flange 68. As best shown in FIG. 8, the semicircular flange 68 is initially disposed on a side diametrically opposite from the semicircular locking projection 58. The centering shaft 33 is then turned in one direction (e.g., clockwise direction as shown in FIGS. 8 and 9) through an angle of 90 to 180 degrees Clockwise rotation of the centering shaft 33 causes the semicircular flange 68 to fit in the circumferential locking groove 58*a* of the semicircular locking projection 58. With this interlocking engagement between the semicircular flange 68 and the semicircular locking projection 58, the centering shaft 33 is set in a correct position with respect to the front-and-rear direction (lengthwise direction) of the watercraft. It will be appreciated that the positioning of the centering shaft 33 in the front-and-rear direction of the watercraft 10 (which corresponds to the axial direction of the centering shaft 33) can be achieved by merely turning the centering shaft 69 about its own axis until the semicircular flange 68 fits in the circumferential locking groove 58*a* of the semicircular locking projection 58.

Figure 10:
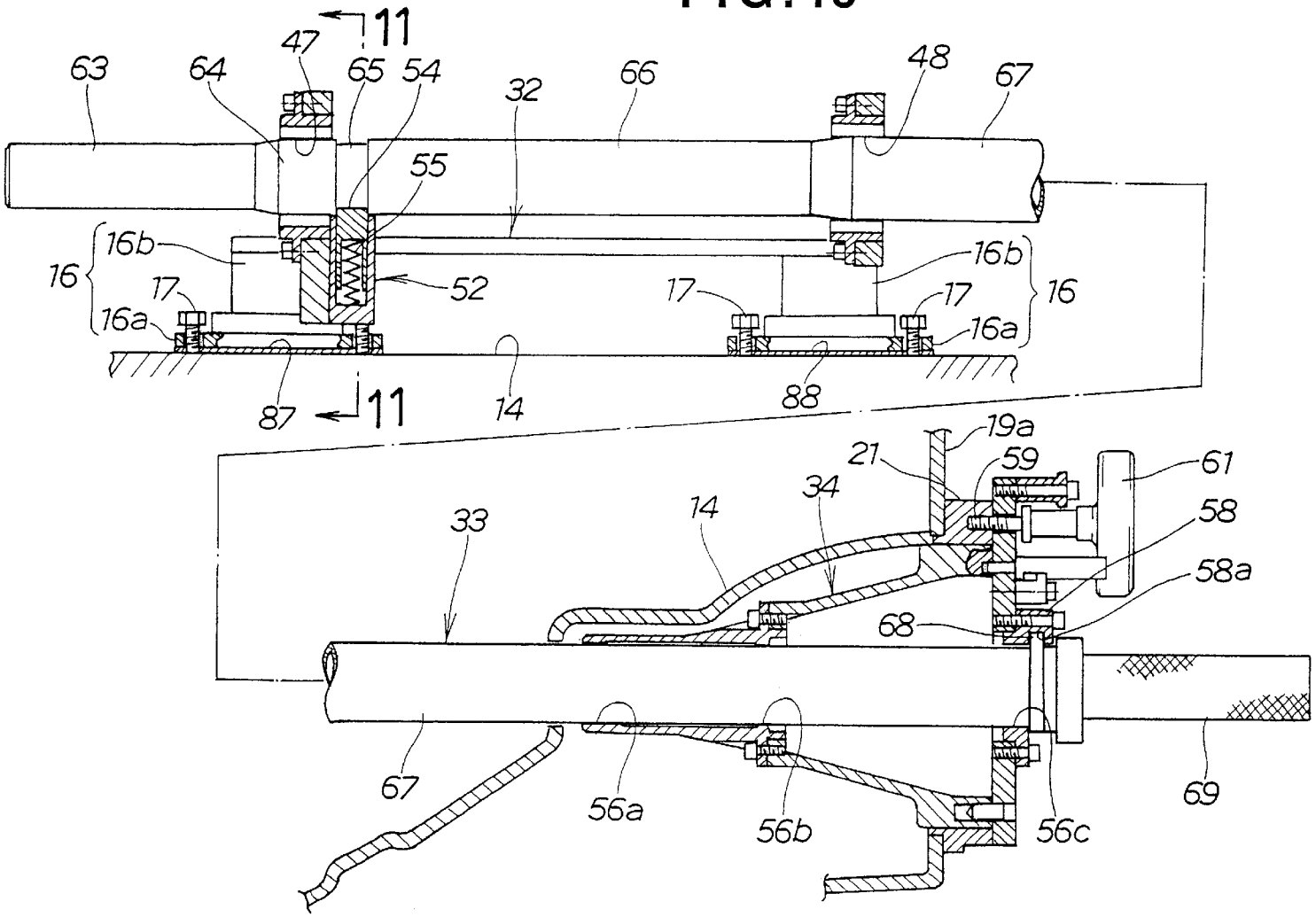

When the centering shaft 33 is in the axially locked state discussed above, the first large-diameter portion 64 and the third large-diameter portion 67 of the centering shaft 33 are slidably received in the front through-hole 47 and the rear through-hole 48, respectively, of the engine lower part dummy 32, as shown in FIG. 10. As previously described, the diameters of the front through-hole 47 and the first large-diameter portion 63 are so determined as to form a slide fit therebetween, and the diameters of the rear through-hole 48 and the third large-diameter portion 67 are also so determined as to form a slide fit therebetween. Accordingly, in the state of the engine lower part dummy 32 and the centering shaft 33 being shown in FIG. 6, if the mutually aligned front and rear through-holes 47, 48 are laterally offset from the axis of the centering shaft 33, leftward movement of the centering shaft 33 will cause interference between each of the front and rear through-holes 47, 48 and a corresponding one of the first and third large-diameter portions 64, 67. Thus, when the centering shaft 33 shown in FIG. 7 is forced leftward until it assumes the position of FIG. 10, the engine lower part dummy 32 is slightly displaced in a widthwise direction to cancel out an offset in the widthwise direction of the through-holes 47, 48 relative to the centering shaft 33. With this widthwise displacement of the engine lower part dummy 32, the engine mounts 16 that are connected to the dummy 32 are correctly positioned in the widthwise direction of the watercraft.

Figure 11:
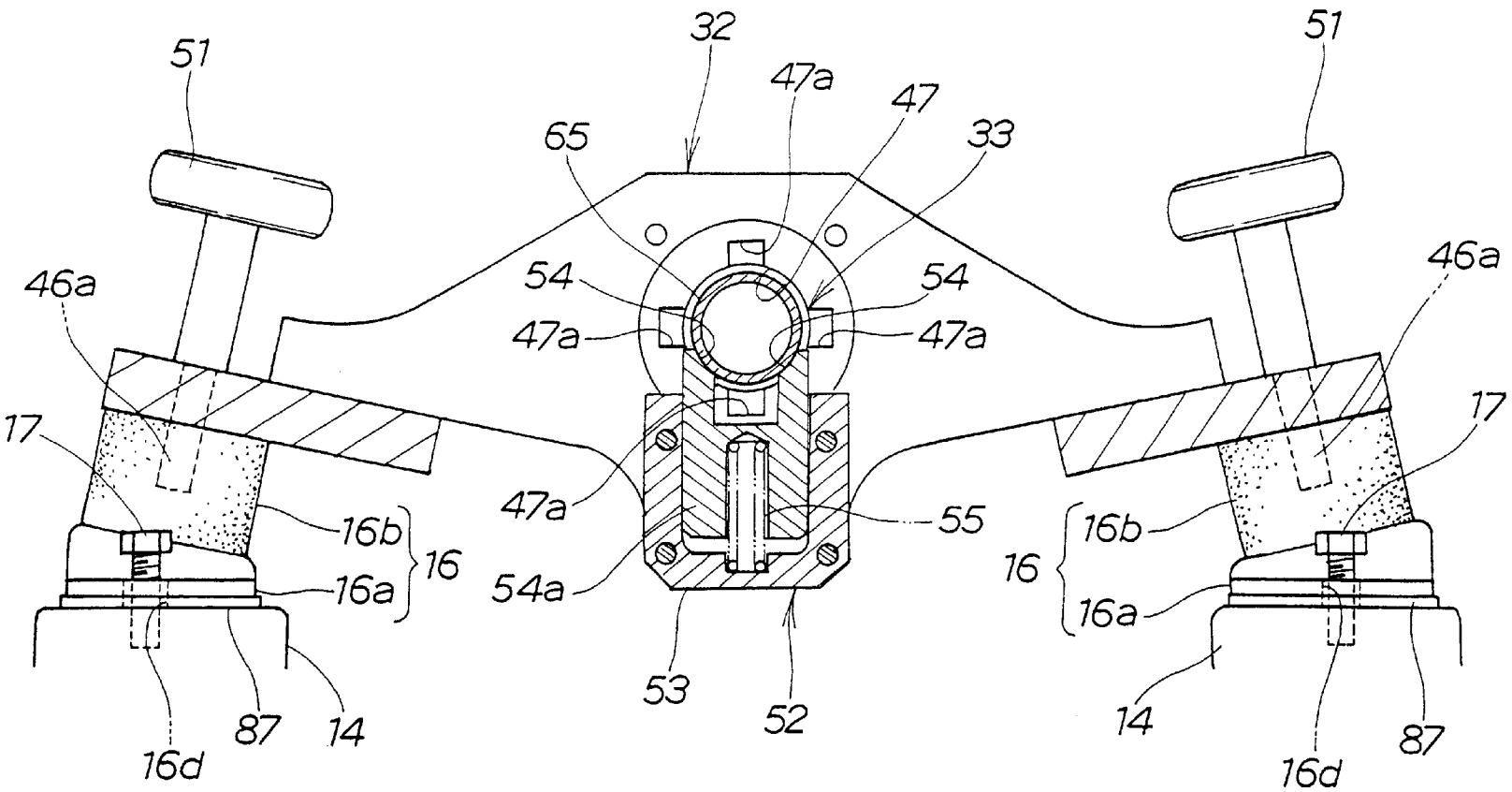

Then, the engine lower part dummy 32 is slightly displaced in the front-and-rear direction of the watercraft (which is identical to the axial direction of the centering shaft 33) to ensure that the locking prongs 54, 54 of the lock device 52 are snugly received in the circumferential groove 65 of the centering shaft 33, as shown in FIG. 10. As best shown in FIG. 11 (which is a cross sectional view taken along line 11—11 of FIG. 10), the lock device 52 is provided on the engine lower part dummy 32 and includes a slide block 54*a* disposed vertically and slidably received in the case 53 with its upper part projecting outward from the open upper end of the case 53, and a compression coil spring 55 acting between the case 53 and the slide block 54*a* to urge the latter upward. The upper part of the slide block 54*a* is centrally recessed or grooved so as to form the two locking prongs 54, 54 on opposite sides of the central groove (not designated). The locking prongs 54, 54 are symmetrical in configuration with respect to a vertical plane passing through the center of the front through-hole 47. The locking prongs 54 have a thickness (a dimension as measured in the axial direction of the centering shaft 33) which is slightly smaller than the width of the circumferential groove 65 of the centering shaft 33.

Accordingly, if the engine lower part dummy 32 is in a correct position with respect to the front-and-rear direction of the watercraft, arrival of the centering shaft 33 at the fully advanced position (corresponding to the axially locked position) shown in FIG. 10 allows the locking prongs 54, 54 to automatically fit in the circumferential groove 65 of the centering shaft 33 under the force of the compression spring 55. Alternatively, if the engine lower part dummy 32 is offset from the correct position toward the front or the rear direction of the watercraft (that is, in the axial direction of the centering shaft 33), the locking prongs 54 are not allowed to enter the circumferential groove 65 but forced by an edge of the circumferential groove 65 to retract into the case 53 against the force of the compression coil spring 66. In the latter case, the engine lower part dummy 32 is slightly displaced in the front-and-rear direction to ensure that the locking prongs 54, 54 are allowed to fit in the circumferential groove 65 of the centering shaft 33 under the force of the compression spring 55. The positioning of the engine mounts 16 in the front-and-rear direction (lengthwise direction) of the watercraft is thus completed.

Figure 12:
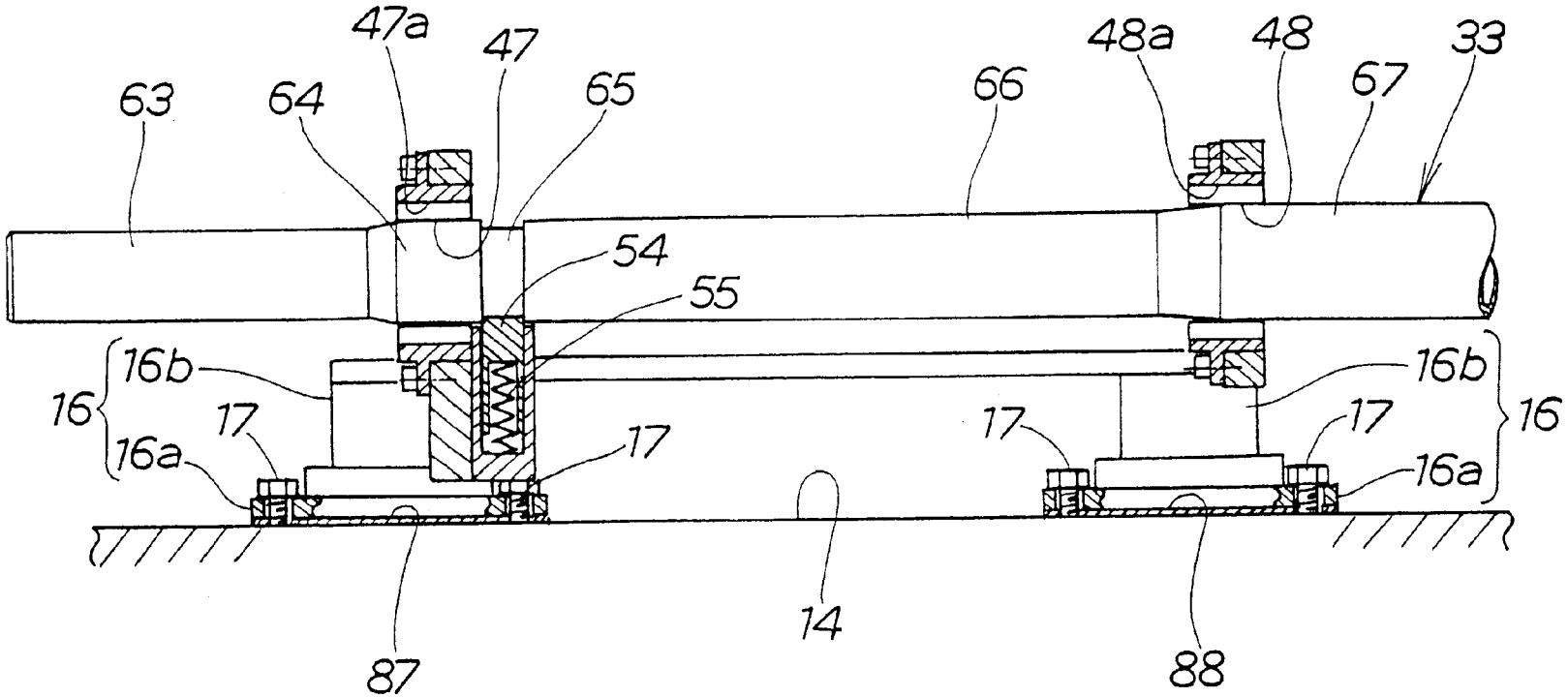

By virtue of the vertical positioning (FIGS. 7–8), widthwise positioning (FIGS. 7–10) and lengthwise positioning (FIGS. 10–11) of the engine lower part dummy 32 discussed above, the front and rear engine mounts 16 are now located in a correct position with respect to the vertical direction, widthwise direction and lengthwise direction of the watercraft. Thus, the screws 17 are tightly fastened to secure the engine mounts 16 to the bottom part 14 of the hull 11, as shown in FIG. 12.

Then, the centering shaft 33 is first turned in a direction to release the semicircular flange 68 (FIG. 13A) from interlocking engagement with the semicircular locking projection 58 and subsequently pulled rearward (rightward in FIG. 13) until it is removed form the pump dummy 34. Thereafter, the knock pin 59*a* (FIG. 6) provided on the pump dummy 34 is removed, and the handle 61 of each screw 59 on the pump dummy 34 is rotated in the loosening direction until the screw 59 is removed from the corresponding threaded mount hole 41*b* of the thrust plate 41. The pump dummy 34 is then detached from the thrust plate 21, as indicated by the arrows shown in FIG. 13A.

Figure 13A:
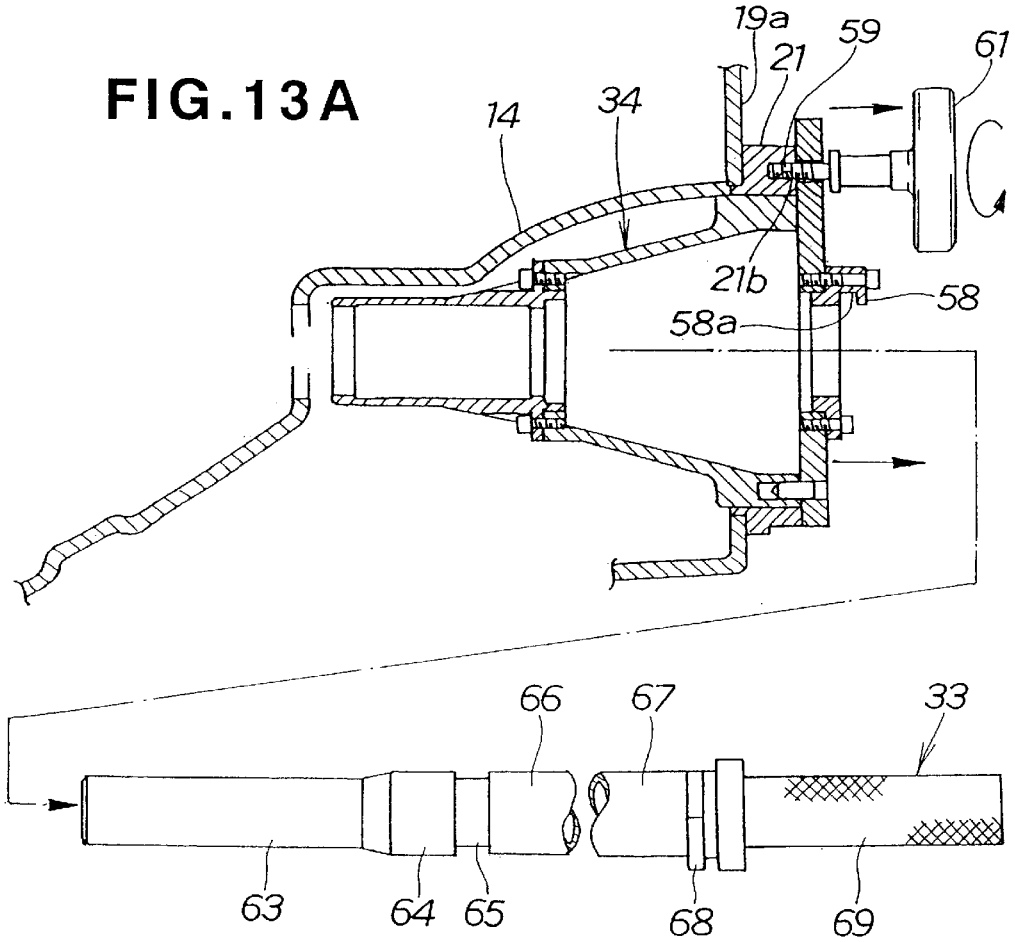
Figure 13B:
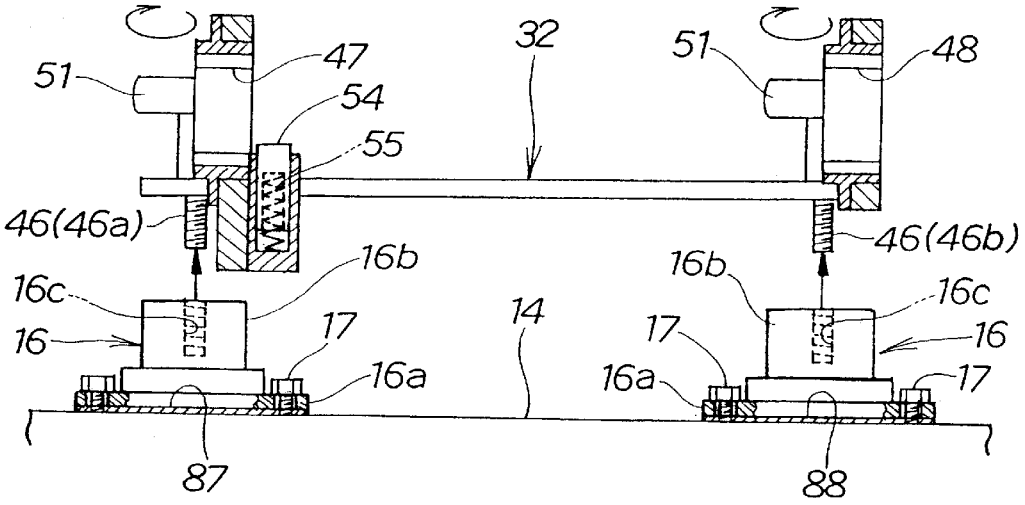

Subsequently, as shown in FIG. 13B, the handle 51 of each screw 46 (46*a*, 46*b*) on the engine lower part dummy 32 is rotated in the loosening direction until the screw 46 is removed from the threaded hole 16*c* of the corresponding engine mount 16. Then, while gripping the grip handles 29, 49 (FIG. 2), the engine lower part dummy 32 is lifted upward so that the engine lower part dummy 32 is detached from the engine mounts 16. The engine mounts 16 left attached to the bottom part 14 of the hull are in a correct position suitable for installation of a real engine.

Figure 14:
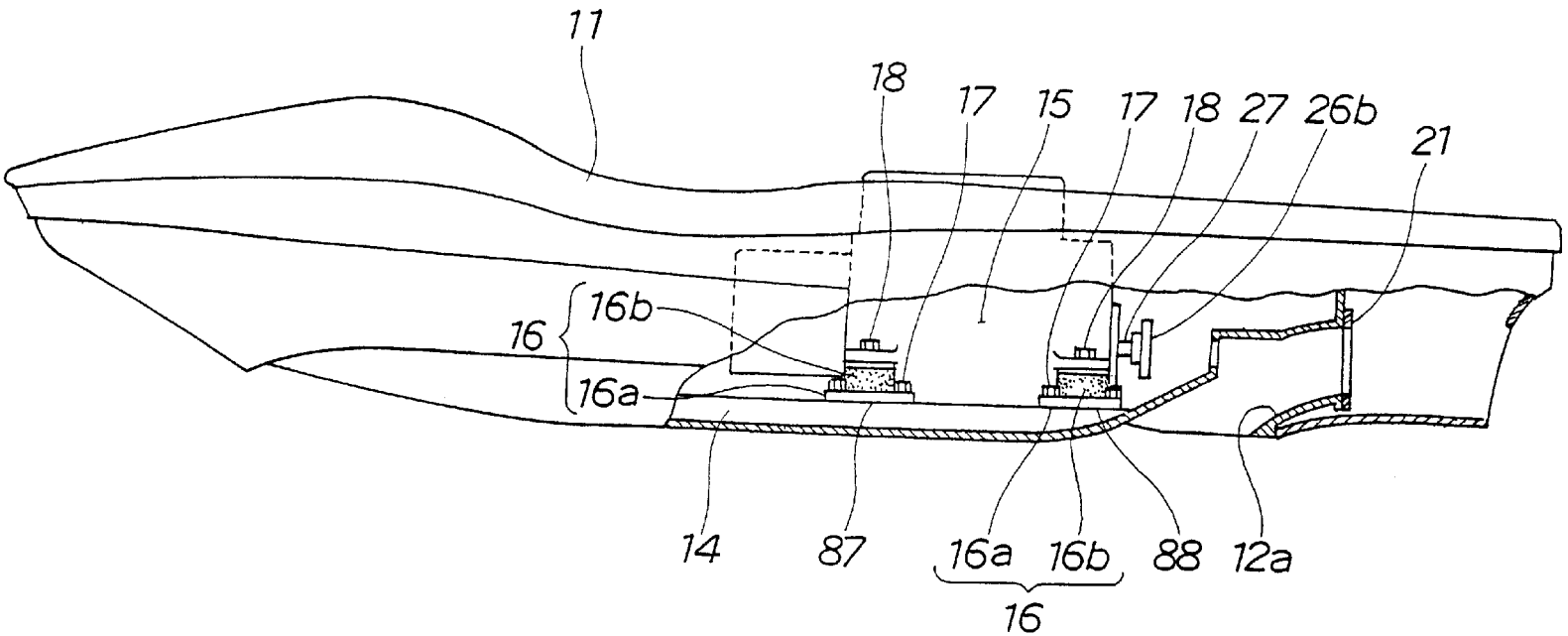
FIG. 14 is a side view, with parts cut-away for clarity, of a small planing watercraft having an engine installed in a hull of the watercraft via the engine mounts which have been positioned by the use of the engine positioning jig.

Thereafter, as shown in FIG. 14, an engine 15 is placed on the correctly positioned engine mounts 16, and the bolts 18 are threaded into the threaded holes 16*c* (FIG. 2) of the engine mounts 16 to thereby secure the engine 15 to the engine mounts 16. The engine 15 is thus installed in the hull 11 via the engine mounts 16. Since the engine 15 is mounted on the correctly positioned engine mounts 16, it is considered that the output shaft 27 of the engine 15 and the coupling member 26*b* provided on the engine output shaft 27 are also positioned correctly with respect to the rotating shaft 24 (FIG. 2) of the jet pump 20 which is later mounted on the hull 11. This means that when the jet pump 20 (FIG. 1) is attached to the thrust plate 21, the rotating shaft 24 of the jet pump 20 is automatically placed in a position coaxial with the engine output shaft 27.

Figure 15:
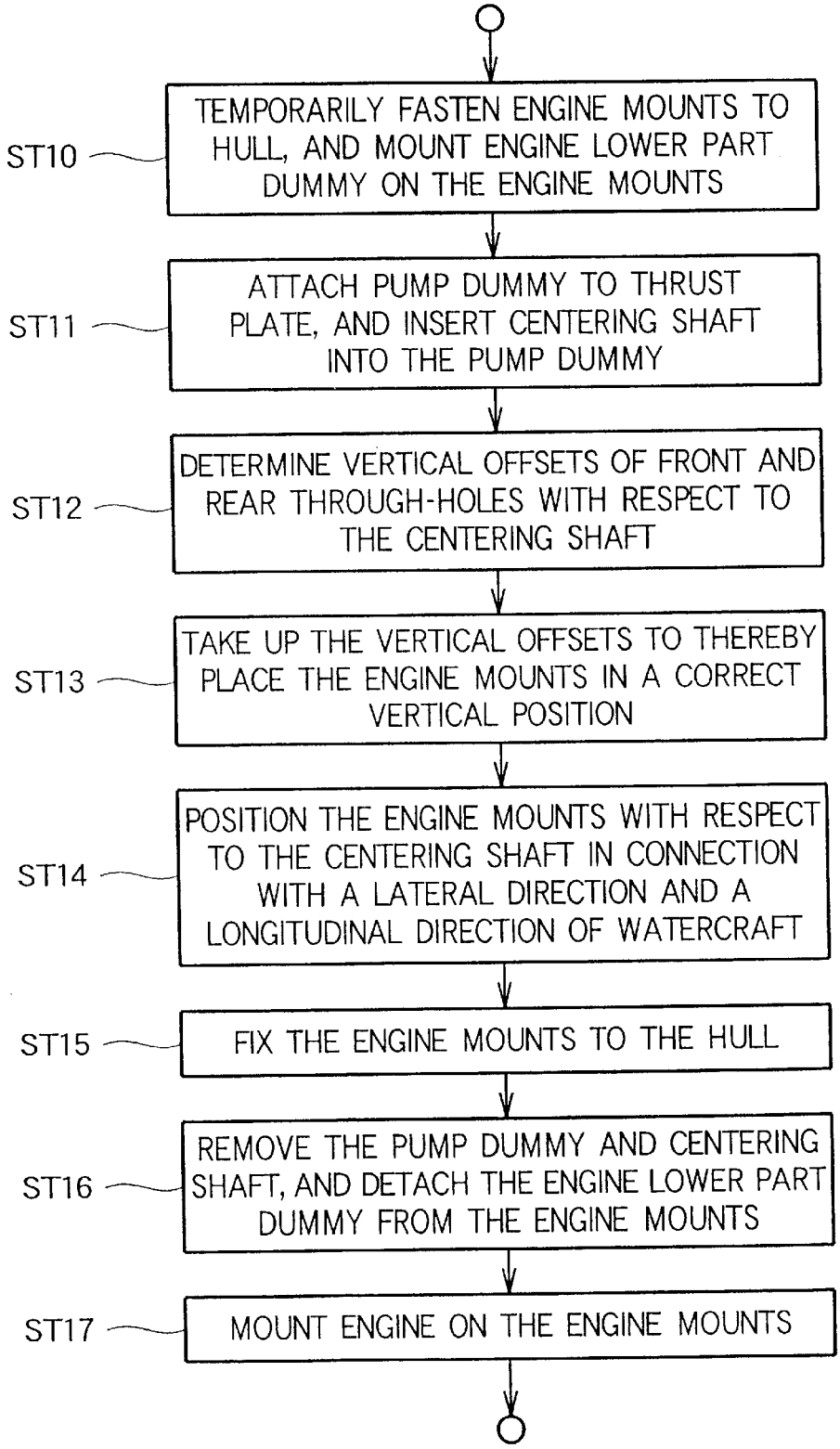
FIG. 15 is a flowchart showing a sequence of operations achieved to carry out the engine installation work shown in FIGS. 3A through 14.

FIG. 15 is a flowchart showing a sequence of operations achieved to install the engine 15 in the hull 11 of the watercraft 10 by using the engine positioning jig 31 of the present invention. As shown in FIG. 15, the operation sequence begins at a step ST10 where the engine mounts 16 are temporarily fastened to the bottom part 14 of the hull 11 in such a manner that the engine mounts 16 are allowed to move in all of the vertical, widthwise and lengthwise directions of the watercraft 10 to some extent, and after that the engine lower part dummy 32 is mounted on the engine mounts 16 (see FIGS. 3A and 2B).

Subsequently, at a step ST11, the thrust plate 21 is attached to the vertical wall 19*a* of the jet pump chamber 19, and the pump dummy 24 is attached to the thrust plate 21, and after that the centering shaft 33 is inserted in the pump dummy 34 (see FIGS. 4A, 4B and 5).

Then, at a step ST12, the gauge block 85 is inserted in the upper section of the vertical part of the cross-shaped radial groove 47*a* of the front circular through-hole 47 so as to determine a vertical offset of the front through-hole 47 with respect to the axis of the centering shaft 33. The gauge block 85 is also inserted in the upper section of the vertical part of the cross-shaped radial groove 48*a* of the rear circular through-hole 48 so as to determine a vertical offset of the rear through-hole 48 with respect to the axis of the centering shaft 33 (see FIG. 6).

Next, at a step ST13, the front shim 87 is placed between each front engine mount 16 and the bottom hull part 14 to take up the vertical offset of the front through-hole 47 with respect to the axis of the centering shaft 33, thus completing vertical positioning of the front engine mounts 16. Similarly, the rear shim 88 is placed between each rear engine mount 16 and the bottom hull part 14 to take up the vertical offset of the rear through-hole 48 with respect to the axis of the centering shaft 33, thus completing vertical positioning of the rear engine mounts (see FIG. 7).

Subsequently, at a step ST14, the front and rear engine mounts 16 are positioned relative to the axis of the centering shaft 33 with respect to the widthwise (left-and-right) and lengthwise (front-and-rear) directions of the watercraft 10 (see FIGS. 8–11). The front and rear engine mounts 16 are now placed in a correct position.

Then, at a step ST15, while the front and rear engine mounts 16 are kept immovable at the correct position, the bolts 17 are tightly fastened so that the engine mounts 16 are firmly secured at the correct position to the bottom hull part 14 (see FIG. 12).

Next, at a step ST16, the pump dummy 34 and the centering shaft 33 are removed from the bottom hull part 14 and the engine lower part dummy 32 is detached from the engine mounts 16 (see FIGS. 13A and 13B).

Finally, at a step ST17, the engine 15 is firmly set on the engine mounts 16 whereby the coupling member 26*b* provided on the output shaft 27 of the engine 15 is located in a correct position.

As thus for explained, the engine mounts 16 are temporarily fastened to the bottom hull part 14 in such a manner that they are allowed to move in all directions including vertical, widthwise and lengthwise directions of the watercraft 10. The engine lower part dummy 32 of the engine positioning jig 31 is attached by the screws 46 to the engine mounts 16, and the pump dummy 34 of the engine positioning jig 31 is attached to the bottom hull part 14 via the thrust plate 21 and the centering shaft 33 is inserted in the pump dummy 34. The engine lower part dummy 32 is displaced in the vertical, widthwise and lengthwise directions with respect to the centering shaft 33 so that the engine mounts 16 are placed in a correct position. After the engine mounts 16 are firmly secured at the correct position to the bottom hull part, the engine lower part dummy 32 is detached from the engine mounts 16 and the real engine 15 is mounted on the engine mounts 16. The engine 15 thus mounted is also placed in a correct position.

Since the engine lower part dummy 32 is much smaller in weight than the real engine 15, positioning of the engine mounts 16 can be achieved easily in a relatively short time without requiring a dexterous crane work. The engine installation work is completed in a relatively short time, so that the watercraft 10 can be manufactured with improved productivity and at a relatively low cost.

Next, description will be given to the operation of the position inspection jig 35 of the engine alignment jig assembly 30 with reference to FIGS. 16 to 19. As shown in FIG. 16, the inspection pump dummy 36 of the position inspection jig 35 (FIG. 2) is inserted from the opening 21*a* of the thrust plate 21 into the suction hole 12*a* of the hull 11 (FIG. 1), and the two screws 74 (only one being shown) on the inspection pump dummy 36 are threaded into corresponding two threaded mount holes 21*b* of the thrust plate 21 by rotating the handles 75 in a tightening direction (clockwise direction). The inspection pump dummy 36 is thus attached to the thrust plate 21.

Figure 18:
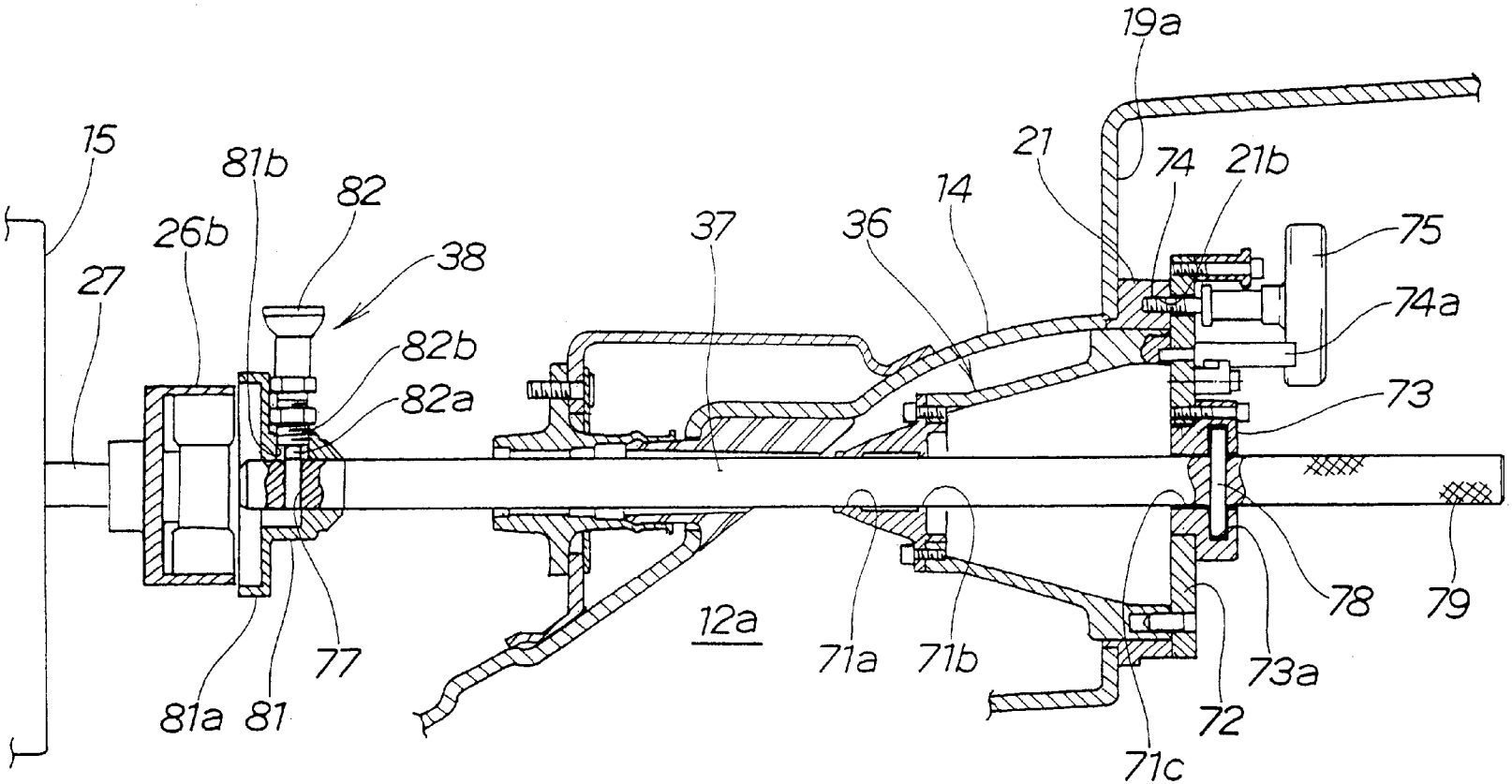

In order to improve the positioning accuracy of the inspection pump dummy 36 with respect to the thrust plate 21, a suitable positioning means, such as a knock pin 74*a* may be used as shown in FIG. 18. The knock pin 74*a* is provided on the end plate 72 of the inspection pump dummy 36 in such a manner that the knock pin 74*a* is removably receivable in the positioning hole (not designated) formed in the thrust plate 21, in the same manner as the knock pin 59*a* on the pump dummy 34. When the knock pin 74*a* fits in the positioning hole in the thrust plate 21, two diagonally opposed threaded mount holes 21*b* (FIG. 2) of the thrust plate 21 and the two screws 74 on the inspection pump dummy 36 are in correct alignment with each other.

In the state of the inspection pump dummy 36 being attached to the thrust plate 21 as shown in FIG. 16, the first to third coaxial support holes 71*a*–71*c* are disposed in a position coaxial with the rotating shaft 24 (FIG. 1) of the impeller 23. Then, the inspection shaft 37 is inserted into the inspection pump dummy 36 so that the inspection shaft 37 slidably fits with the first, second and third support holes 71*a*, 71*b* and 71 of the inspection pump dummy 36. The inspection shaft 37 thus inserted assumes the same position as the rotating shaft 24 of the jet pump 20.

Subsequently, the inspection coupler 38 is fitted around the fore-end portion 37*a* of the inspection shaft 37, as indicated by the arrow shown in FIG. 16. The inspection shaft 37 is then forced in the forward direction (leftward direction in FIG. 16) so that the lock pin 78 on the inspection shaft 37 passes through a gate 73*b* of the circular locking socket 73 then enters an annular locking groove 73*a* of the locking socket 73. The locking groove 73*a* has a depth slightly larger than the outside diameter of the lock pin 78.

In the illustrated embodiment, since the position inspection jig 35 is used with a sleeve-like seal member 89 fitted in a holed wall part 12*b* of the suction hole 12, the outside diameter of the inspection shaft 37 is determined depending on the inside diameter of the sleeve-like seal member 89. By contrast, the outside diameter of the centering shaft 33 (FIG. 2) is determined independently from the inside diameter of the sleeve-like seal member 89 because the engine positioning jig 31 is used before the seal member 89 is provided in the holed wall part 12*b* of the suction hole 12*a*. Due to the presence of the seal member 89, the outside diameter of the inspection shaft 37 is made smaller than that of the centering shaft 33. This makes it necessary to provide the inspection pump dummy 36 separately from the pump dummy 34 (FIG. 2). In the case where the position inspection jig 35 is used before the seal member 89 is provided in the holed wall part 12*b* of the suction hole 12*a*, the pump dummy 34 of the engine positioning jig 31 can be also used as an inspection dummy of the position inspection jig 35.

Figure 17:
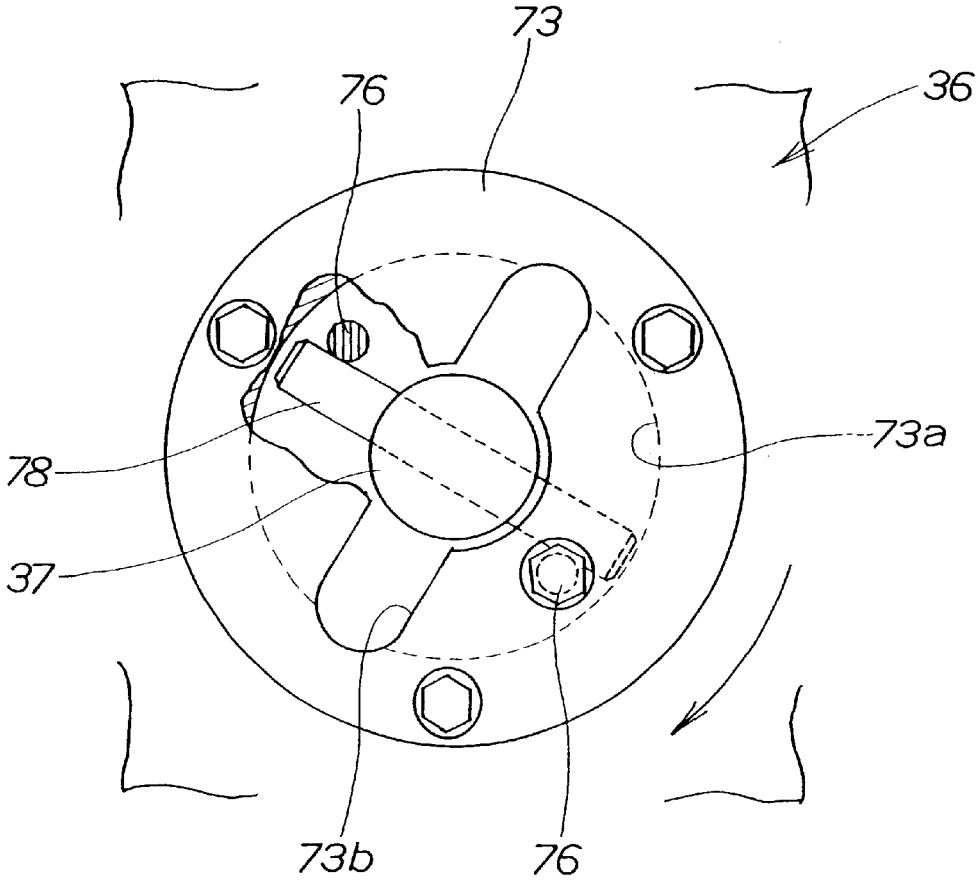

After the lock pin 78 has moved in the annular locking groove 73*a*, the inspection shaft 37 is turned in either direction (clockwise direction, for example, as indicated by the arrow shown in FIG. 16) through an angle of about 90 degrees. This movement of the inspection shaft 37 causes the lock pin 78 to turn in the same direction within the locking groove 73*a* to such an extent that it comes in abutment with stop pins 76 disposed in the locking groove 73*a* in diametrically opposite relation, as shown in FIG. 17. The gate 73*b* of the circular locking socket 73 is in the form of an oblong hole extending radially across the center of the circular locking socket 73, and the stop pins 76 are disposed such that the lock pin when engaged with the stop pins 76 is about 90° out of phase with the gate 73*b*. Since the lock pin 78 received in the locking groove 73*a* is angularly displaced from the gate (oblong hole) 73*b*, the inspection shaft 37 is locked in position against axial movement relative to the inspection pump dummy 36.

By thus locking the inspection shaft 37 through interlocking engagement between the lock pin 78 and the locking socket 73, the inspection shaft 37 is placed in a correct position with respect to the axial direction thereof (the front-and-rear direction of the watercraft), as shown in FIG. 18. The axial positioning operation of the inspection shaft 37 can be achieved merely by forcing the inspection shaft 37 forwardly to cause the lock pin 78 to move into the locking groove 73*a* through the gate 73*b* (FIG. 17) and then turning the inspection shaft 37 through an angle of about 90 degrees to move the lock pin 78 to a locking position angularly displaced from the position of the gate 73*b*.

The inspection coupler 38 mounted on the fore-end portion 37*a* of the inspection shaft 37 is used to determine whether or not the coupling member 26*b* mounted on the output shaft 27 of the engine 15 is in the correct position. The locking knob 82 of the inspection coupler 38 has a positioning pin 82*a* at a front end thereof, and a threaded shank 82*b* contiguous to the positioning pin 82*a*. The positioning pin 82*a* has an outside diameter slightly smaller than the inside diameter of the radial locking hole 77 of the inspection shaft 37. The threaded shank 82*b* has a larger outside diameter than the positioning pin 82*a* and is threaded into a threaded radial hole 81*b* of the disc-like coupler body 81. The coupler body 81 has a cylindrical wall 81*a* at a front end thereof The cylindrical wall 81*a* has an inside diameter made slightly larger than the outside diameter of the coupling member 26*b* on the engine output shaft 27 for a purpose described later on.

Figure 19A:
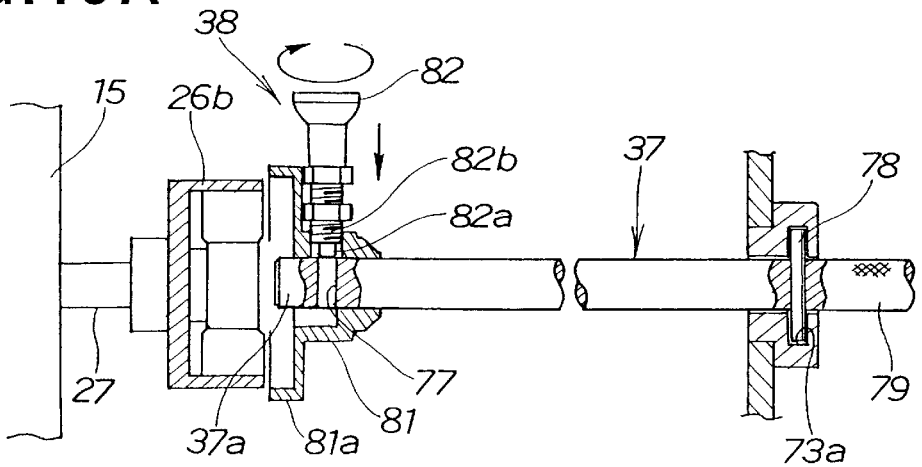

Operation of the inspection coupler 38 will be described in greater detail with reference to FIGS. 19A through 19C. At first, with an enlarged head of the locking knob 82 being gripped by the operator, the inspection coupler 38 is displaced in the axial and circumferential directions of the inspection shaft 37 in an appropriate manner to realize that a positioning pin 82*a* of the locking knob 82 assumes a position aligned with the radial locking hole 77 of the inspection shaft 37, as shown in FIG. 19A. Then, the locking knob 82 is turned clockwise as indicated by the arrow in FIG. 19A, so that the threaded shank 82*b* of the locking knob 82 advances to thereby lower the locking knob 82.

Figure 19B:
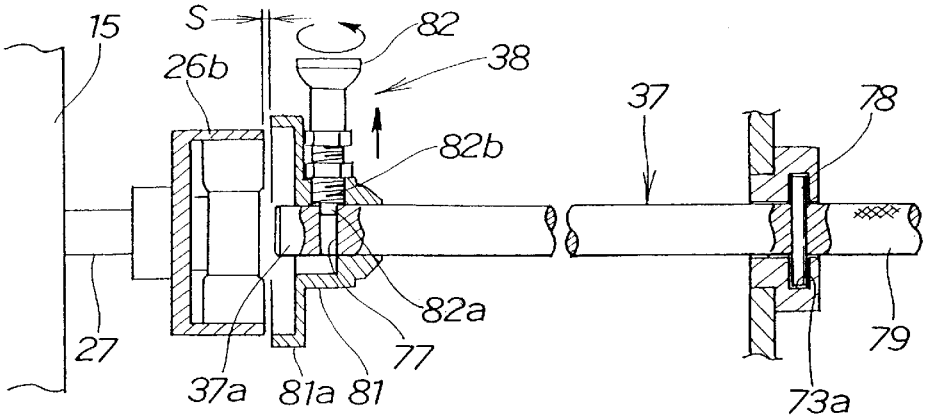

With this downward movement of the locking knob 82, the positioning pin 82*a* fits in the radial locking hole 77 in the inspection shaft 37, as shown in FIG. 19B. The inspection coupler 38 is thus placed in a correct position (inspecting position) with respect to the axial direction of the inspection shaft 37. In this condition, the spacing S between a rear end of the coupling member 26*b* and a front end of the coupler body 81 of the inspection coupler 38 is measured. If the measured spacing S falls within a prescribed allowable range, this indicates that the rear end of the coupling member 26*b* on the output shaft 27 is disposed in a correct position with respect to the front-and-rear direction of the watercraft. Then, the locking knob 82 is turned counter-clockwise to move the positioning pin 82*a* upward as indicated by the arrow shown in FIG. 19B until the positioning pin 82*a* is removed from the radial locking hole 77.

Subsequently, with the locking knob 82 being gripped by the operator, the inspection coupler 38 is displaced forward (leftward direction in FIG. 19C). In this instance, since the inside diameter of the cylindrical wall 81*a* of the coupler body 81 is slightly larger than the outside diameter of the coupling member 26*b* on the engine output shaft 27 and the inspection shaft 37 assumes the position of the rotating shaft 24 of the jet pump 20, if the cylindrical wall 81*a* of the coupler body 81 fits with an outer circumferential surface of the coupling member 26*b*, this means that the coupling member 26*b* on the engine output shaft 27 is disposed in a position coaxial with the rotating shaft 24 of the jet pump 20. Inspection of the coupling member 26 for axial position and alignment with respect to the inspection shaft 37 (i.e., the rotating shaft of the jet pump 20) can thus be accomplished with utmost ease merely by displacing the inspection coupler 38 along the axis of the inspection shaft 37.

Thereafter, the inspection coupler 38 is removed from the inspection shaft 37, and the inspection shaft 37 and the inspection dummy pump 36 are removed from the bottom hull part 14 (FIG. 16). Inspection work using the position inspection jug 35 (FIG. 2) is thus completed.

A problem may occur, however, that due to the engine mount bodies 16*b* made of rubber, the engine mounts 16 are yielding under the weight (100 kg, for example) of the engine 15 to thereby allow the engine 15 to sink slightly. This problem, when occurs, makes it impossible to perform an inspection of the coupling member 26*b* for alignment with the rotating shaft 24 of the jet pump 20. To deal with this problem, a spacer or shim is inserted between the engine 15 and each engine mount 16 to adjust the height of the engine 15. In connection with this, since the amount of yielding of the engine mounts 16 can be estimated from a spring constant of the rubber used for forming the engine mount bodies 16*b*, a shim of a thickness equal to the estimated amount of yielding of the engine mounts 16 may be placed on each engine mount 16 before the engine 15 is mounted on the engine mounts 16.

Figure 20:
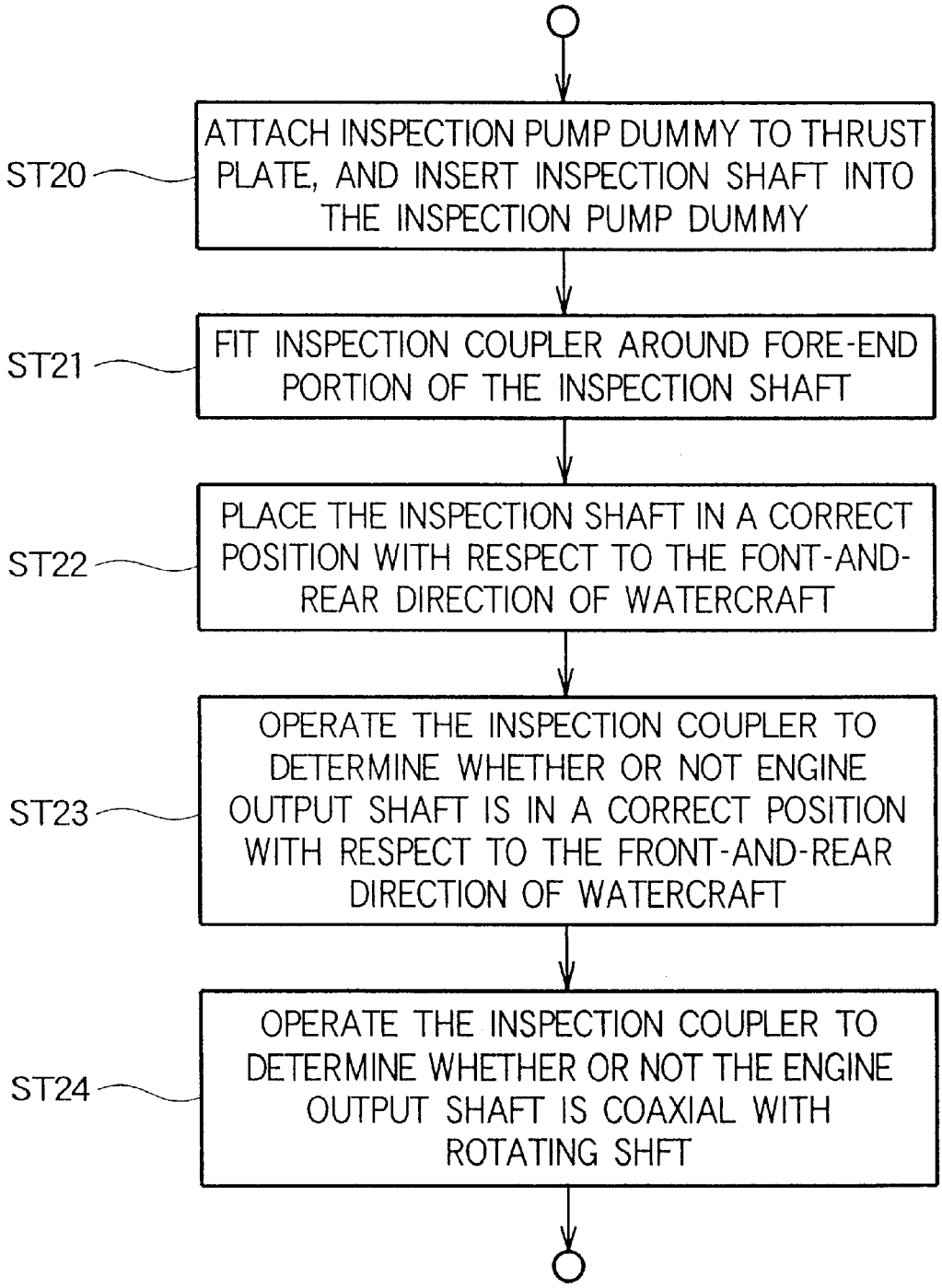
FIG. 20 is a flowchart showing a sequence of operations achieved to carry out the inspection work shown in FIGS. 16 through 19.

After completion of the foregoing inspection, a jet pump 20 (FIG. 1) is attached to the thrust plate 21, then a drive shaft 25 is spline-connected to a rotating shaft 24 of the jet pump 20, and finally a coupling member 26*a* on the drive shaft 25 is connected to the coupling member 26*b* on the engine output shaft 27. The jet pump 20 is thus coupled with the engine 15. FIG. 20 is a flowchart showing a sequence of operations achieved to inspect the engine output shaft 27 for axial position and alignment with the rotating shaft 24 of the jet pump 20 by using the position inspection jig 35 of the present invention. As shown in FIG. 20, the operation sequence begins at a step ST20 where the inspection pump dummy 36 is attached to the thrust plate 21, and the inspection shaft 37 is inserted in the inspection pump dummy 36. The inspection shaft 37 thus inserted is supported by the inspection pump dummy 36 in such a condition that the inspection shaft 37 assumes the position of the rotating shaft 24 of the jet pump 20 which is attached to the thrust plate 21 after the inspection completes (see FIG. 16).

Subsequently, at a step ST21, the inspection coupler 38 is fitted around the fore-end portion 37*a* of the inspection shaft 37 (see FIG. 16).

Then, at a step ST22, the lock pin 78 on the inspection shaft 37 is brought into fitting engagement with the annular locking groove 73*a* of the locking socket (locking member) 73 of the inspection pump dummy 36 to thereby set the inspection shaft 37 in a correct position with respect to the axial direction thereof (see FIGS. 17 and 18).

Next, at a step ST23, by using the inspection coupler 38, affirmation is made to determine whether or not the coupling member 26*b* provided on the engine output shaft 27 is in a correct position with respect to the front-and-rear direction of the watercraft (see FIGS. 19A and 19B).

Figure 19C:
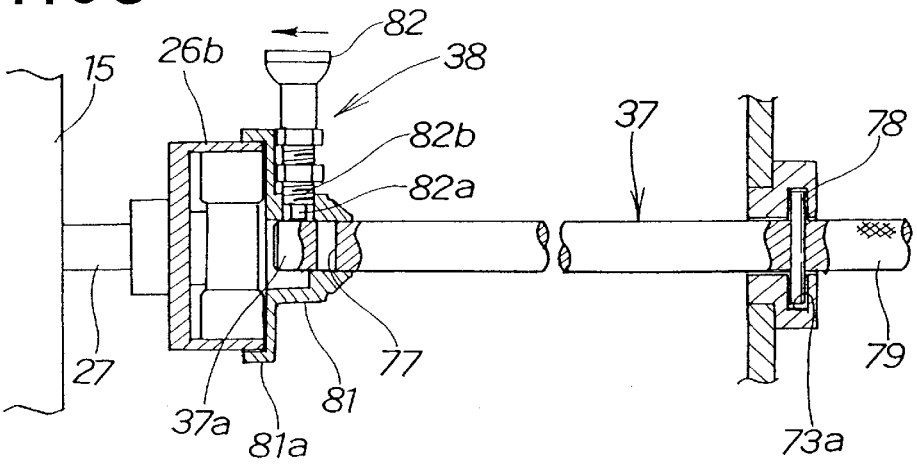

Finally, at a step SST24, by using the inspection coupler 38, affirmation is made to determine whether or not the coupling member 26*b* on the engine output shaft 27 is in a position coaxial with a rotating shaft 24 of the jet pump 20 (see FIG. 19C).

It will be appreciated that the inspection shaft 37, as it is inserted in the inspection pump dummy 36, assumes the position of a rotating shaft 24 of a jet pump 20 which is attached to the thrust plate 21 after the inspection using the inspection jig 35 completes. Furthermore, the axial position and alignment error of the engine output shaft 27 can be readily checked by merely displacing the inspection coupler 38 on and along the inspection shaft 37. Such displacement of the inspection coupler 35 does not require dexterity and, hence, a labor load on the operator is low. This will improve the productivity of the watercraft and reduce the production cost of the watercraft.

Figure 21:
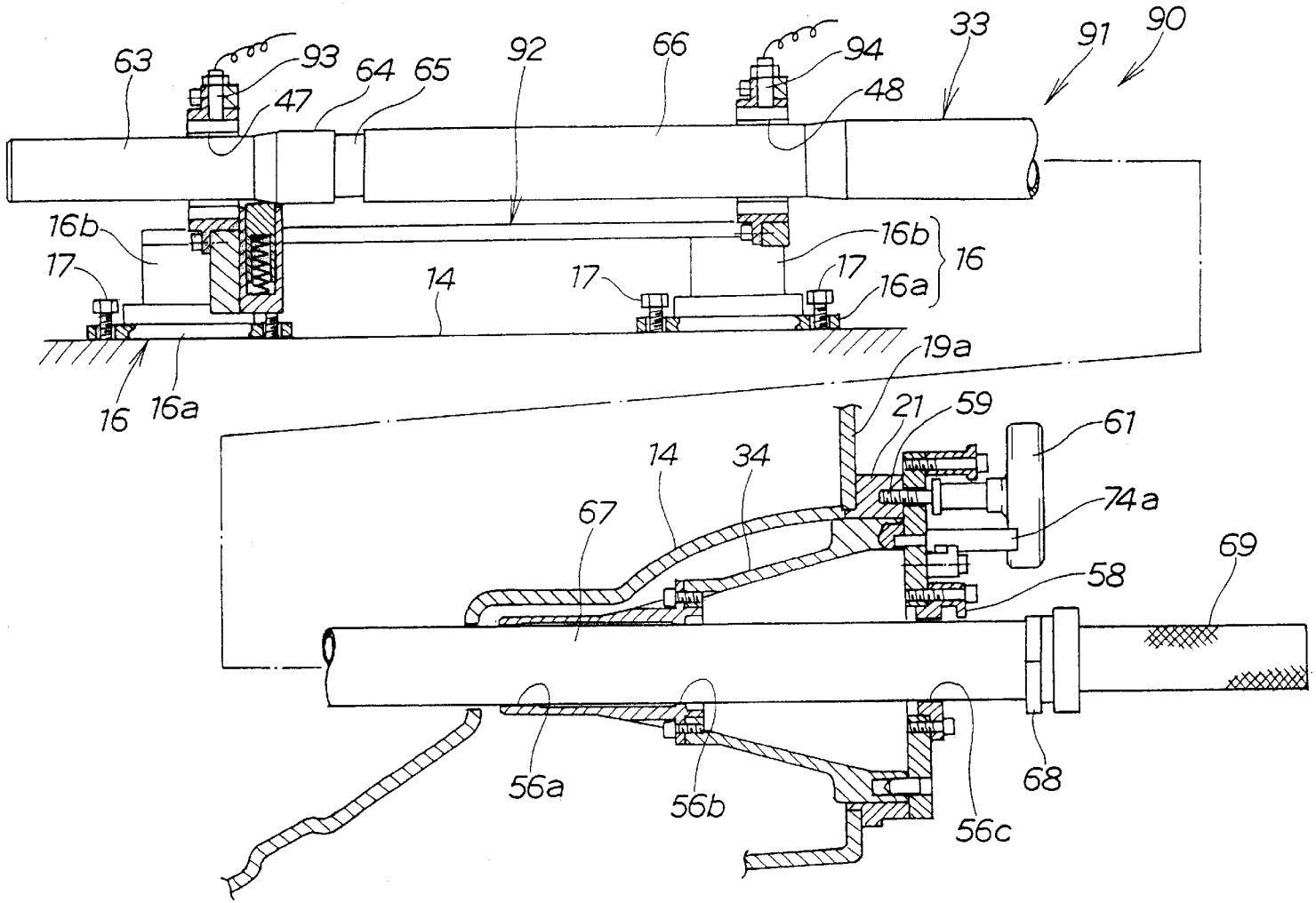
FIG. 21 is a cross-sectional view of an engine alignment jig assembly according to a second embodiment of the present invention, including an improved engine positioning jig.

FIG. 21 is a view similar to FIG. 6, but showing a part of an engine alignment jig assembly according to a second embodiment of the present invention. The engine alignment jig assembly 90 includes an engine positioning jig 91. The engine positioning jig 91 is structurally and operationally the same as the engine positioning jig 30 of the first embodiment shown in FIGS. 2–15 with the exception that a front depth indicator 93 and a rear depth indicator 94 are provided on an engine lower part dummy 92 adjacent a front through-hole 47 and a rear through-hole 48, respectively. The depth indicators 93, 93 are disposed on a vertical plane passing through the centers of the through-holes 47, 48. In FIG. 21, these parts which are identical or corresponding to those shown in the first embodiment are designated by the same reference characters, and a further description thereof can be omitted.

The front and rear depth indicators 93, 94 comprise an ultrasonic direct-reading instrument which employs frequencies above the audible range to determine the depth (vertical thickness) of a clearance formed between a circumferential wall of each through-hole 47, 48 and an outer circumferential surface of a corresponding one of the small-diameter portion 63 and the second large-diameter portion 66 of the centering shaft 33. The ultrasonic depth indicator 93, 94 measures the time interval between the emission of an ultrasonic signal and the return of its echo from the outer circumferential surface of the centering shaft portion 63 or 66, so as to determine the depth (vertical thickness) of the clearance. Based on a measurement indicated by the front ultrasonic depth indicator 93, a vertical offset of the front through-hole 47 ("front vertical offset") with respect to the axis of the centering shaft 33 can be readily determined. Similarly, a vertical offset of the rear through-hole 48 ("rear vertical offset") with respect to the axis of the centering shaft 33 can be also determined on the basis of a measurement indicated by the rear ultrasonic depth indicator 94.

To cancel out the front vertical offset, a spacer or shim having a thickness equal to the determined front vertical offset is selected and after that the selected shim is placed between the bottom hull part 14 and each front engine mount 16. Similarly, another spacer or shim having a thickness equal to the rear vertical offset is selected and then placed between the bottom hull part 14 and each rear engine mount 16 to thereby cancel out the rear vertical offset. The positioning of the engine mounts 16 in the vertical direction is thus completed.

In the second embodiment discussed above, by virtue of the ultrasonic depth indicators 93, 94 provided on the engine positioning jig 91, the vertical offsets of the front and rear through-holes 47, 48 can be determined automatically without requiring a manual measuring operation, such as done in the first embodiment shown in FIG. 6. Vertical positioning of the engine mounts 16 is accomplished easily as compared to the first embodiment.

Figure 22A:
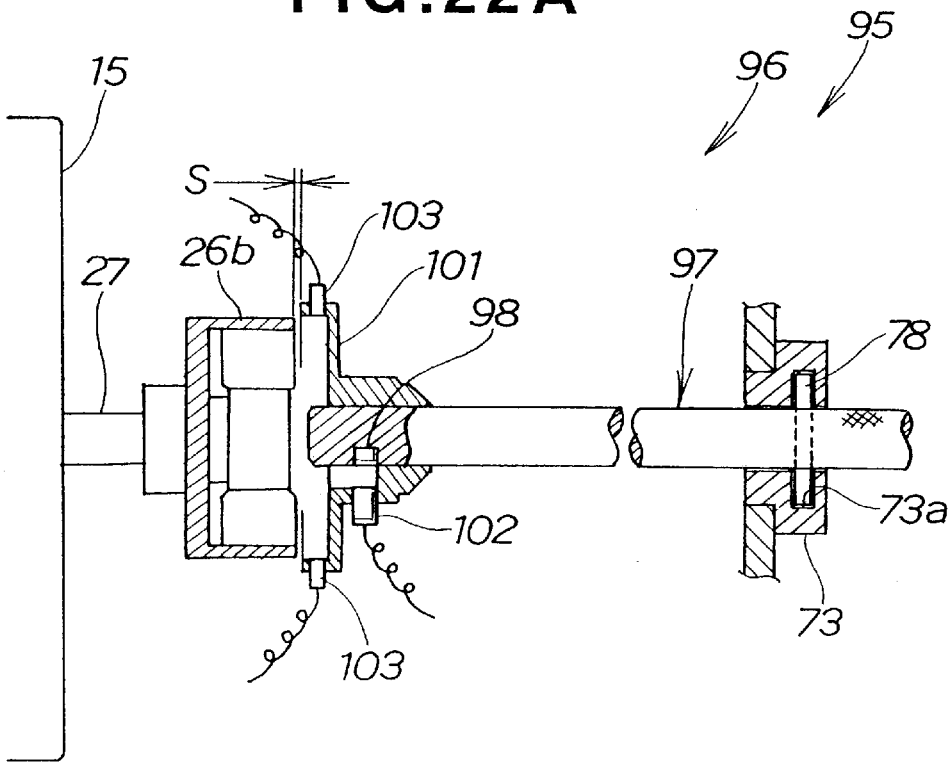
FIGS. 22A and 22B are schematic side views, with parts shown in cross section, of an engine alignment jig assembly according to a third embodiment of the present invention, including a modified position inspection jig.
Figure 22B:
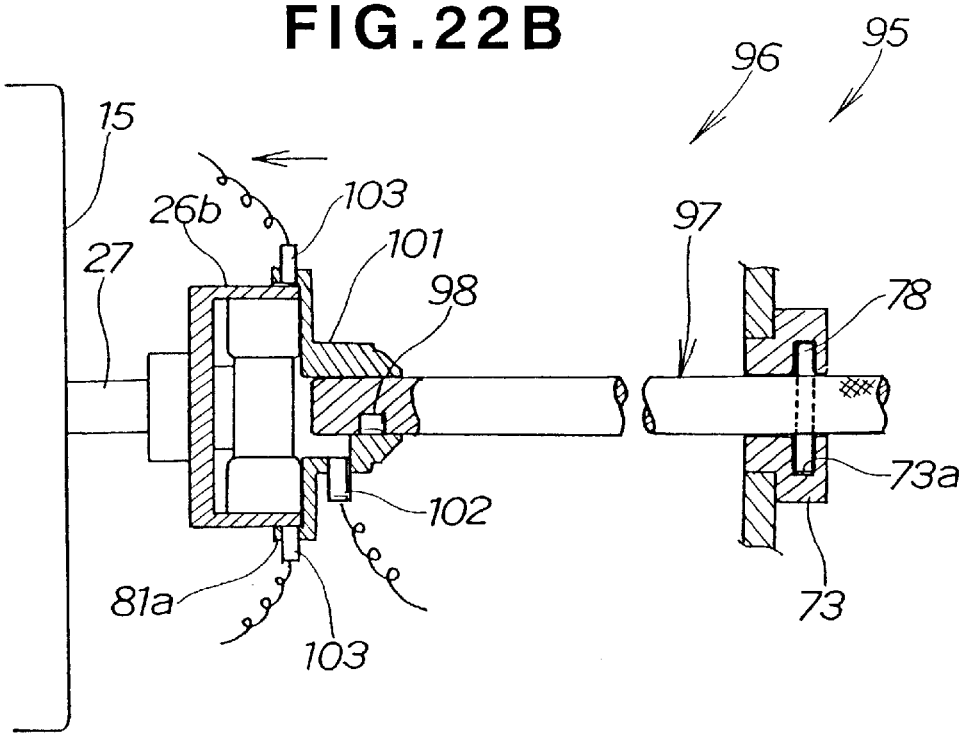

FIGS. 22A and 22B show a part of an engine alignment jig assembly 95 according to a third embodiment of the present invention. The engine alignment jig assembly 95 differs from the engine alignment jig assembly 30 of the first embodiment only in that a position inspection jig 96 includes an axial position sensor 102 and an alignment inspection device 103 both provided on an inspection coupler 101. The axial position sensor 102 preferably comprises a photosensor which, when exposed to light emitted from a light source 98 embedded in a fore-end portion of an inspection shaft 97, generates an electric signal to drive an indicator, such as a lamp or a buzzer (neither shown). The alignment inspection device 103 preferably comprises at least three ultrasonic depth indicators (two being shown) mounted on a cylindrical wall 81*a* of the inspection coupler 101, the depth indicators 103 being spaced at regular intervals in the circumferential direction of the inspection coupler 101. The ultrasonic depth indicators 103 are structurally and functionally the same as the ultrasonic depth indicators 93, 94 of the second embodiment shown in FIG. 21. The cylindrical wall 81*a* of the inspection coupler 101 has an inside diameter slightly larger than the outside diameter of the coupling member 26*b* provided on the output shaft 27 of the engine 15.

In the operation of the position inspection jig 96, the inspection coupler 101, which has been fitted around the fore-end portion of the inspection shaft 97, is displaced in the axial direction of the inspection shaft 97. Axial displacement of the inspection coupler 101 may cause the photosensor 102 to locate at a position opposite to the light source 98 on the inspection shaft 97, as shown in FIG. 22A, whereupon the photosensor 102 generates an electric signal to turn on the non-illustrated lamp or buzzer. Thus, the operator receives a visible or audible notice that the inspection coupler 101 is now in a position prescribed for a subsequent inspection of the axial position of the coupling member 26*b*. Then, the spacing S between a rear end of the coupling member 26*b* and a front end of the inspection coupler 101 is measured. If a measurement of the spacing S falls within a prescribed allowable range, this indicates that the rear end of the coupling member 26*b* on the output shaft 27 is correctly positioned with respect to the front-and-rear direction of the watercraft.

Subsequently, the inspection coupler 101 is displaced forward (leftward direction in FIG. 22A). In this instance, since the inside diameter of the cylindrical wall 81*a* of the inspection coupler 101 is slightly larger than the outside diameter of the coupling member 26*b* on the engine output shaft 27 and the inspection shaft 97 assumes the position of the rotating shaft 24 (FIG. 1) of the jet pump 20, if the cylindrical wall 81*a* of the inspection coupler 101 fits with an outer circumferential surface of the coupling member 26*b*, as shown in FIG. 22B, this means that the coupling member 26*b* on the engine output shaft 27 is disposed in a position coaxial with the rotating shaft 24 of the jet pump 20. Furthermore, by virtue of the alignment inspection device (ultrasonic depth indicators) 103, the amount of alignment error of the engine output shaft 27 relative to the rotating shaft 24 (although such alignment error is still within the allowable range) can be determined quantitatively with high accuracies.

Figure 23:
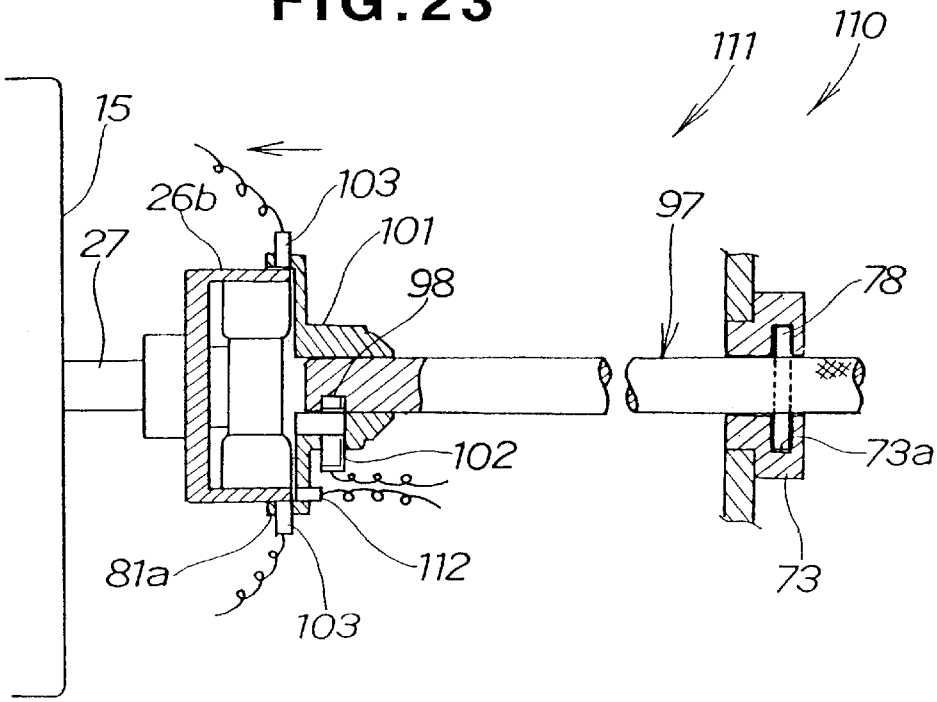
FIG. 23 is a view similar to FIG. 22B, but showing an engine alignment jig assembly according to a fourth embodiment of the present invention including another modified position inspection jig.

FIG. 23 shows a part of an engine alignment jig assembly 110 according to a fourth embodiment of the present invention. The engine alignment jig assembly 110 includes a position inspection jig 111 which is substantially the same as the position inspection jig 96 excepting that a ultrasonic depth indicator 112 is used in combination with the axial position sensor (photosensor) 102 for measuring the axial distance between the coupling member 26*b* on the engine output shaft 27 and the inspection coupler 101 so as to determine whether or not the coupling member 26*b* is correctly positioned with respect to the axial direction of the rotating shaft 24 (FIG. 1) of the jet pump 20 (i.e., the front-and-rear direction of the watercraft). In this embodiment, the photosensor 103 is so arranged as to be activated by light emitted from the light source 98 when the cylindrical wall 81*a* of the inspection coupler 101 fits with the outer peripheral surface of the coupling member 26*b* with a space (not designated) defined between the rear end of the coupling member 26*b* and a front end face of the inspection coupler 101 where the ultrasonic depth indicator 112 is provided.

The fourth embodiment shown in FIG. 23 is advantageous over the third embodiment shown in FIGS. 22A and 22B in that the axial position of the coupling member 26*b* (engine output shaft 27) and the alignment of the coupling member 26*b* (engine output shaft 27) can be inspected at one time when the inspection coupler 101 is displaced to a position where the cylindrical wall 81*a* of the coupler 101 fits around the coupling member 26*b* on the engine output shaft 27. A further improvement in the productivity and an additional cost-reduction can be attained.

Figure 24:
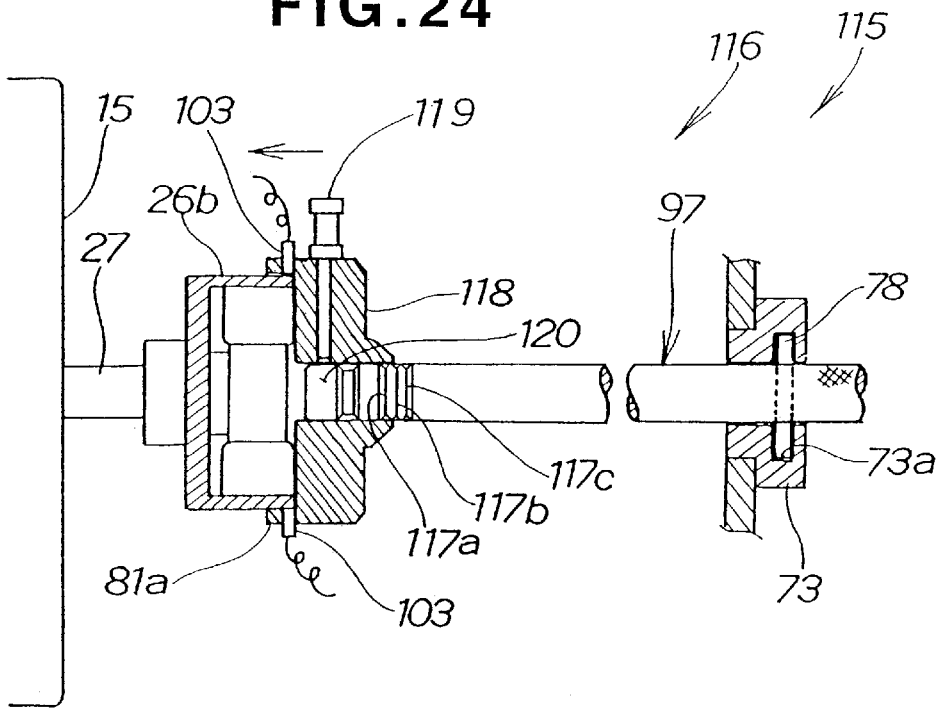
FIG. 24 is a view similar to FIG. 22B, but showing an engine alignment jig assembly according to a fix embodiment of the present invention including a further modified position inspection jig.
Figure 25:
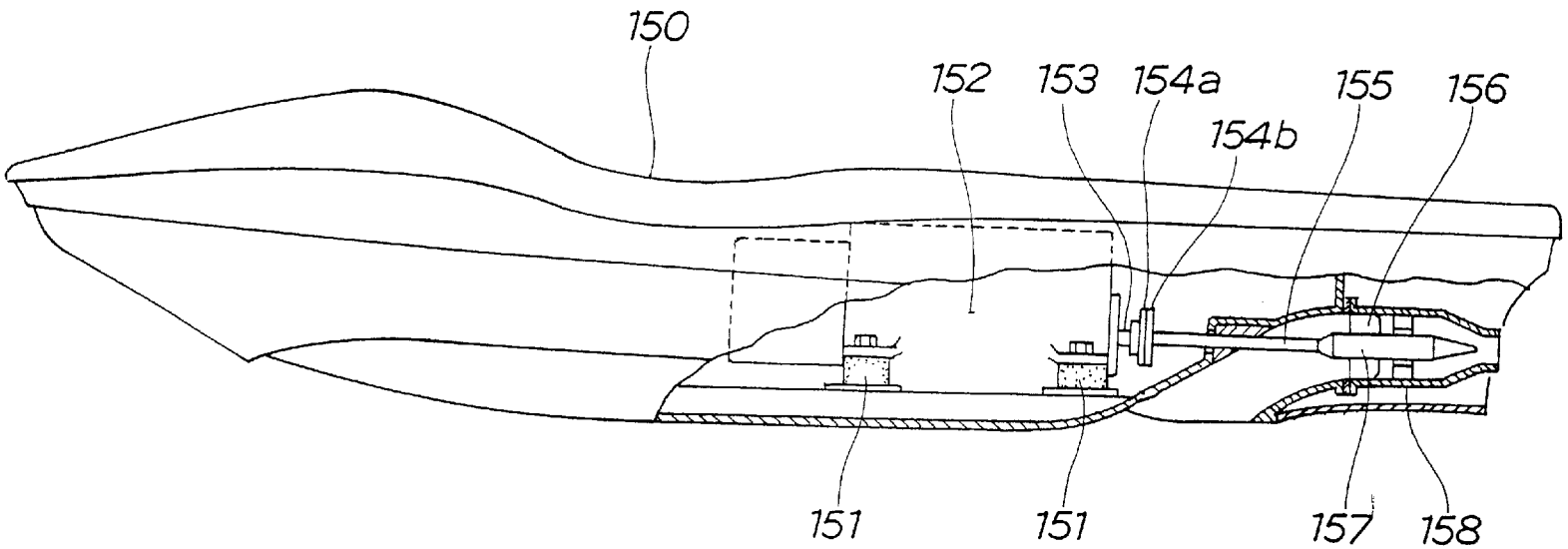
FIG. 25 (PRIOR ART)
FIG. 25 is a side view, with parts cut-away for clarity, of a small planing watercraft having an engine installed in a hull according to a conventional practice.

FIG. 24 shows a part of an engine alignment jig assembly 115 according to a fifth embodiment of the present invention. The engine alignment jig assembly 115 includes a position inspection jig 116 which is different from the position inspection jig 111 of FIG. 23 in that a visual position indicator is provided in place of the ultrasonic depth indicator 112. The visual position indicator comprises three circumferential grooves 117*a*, 117*b* and 117*c* formed in a fore-end portion of an inspection shaft 97, and a rear end face of an inspection coupler 118. The grooves 117*a*–117*c* in the inspection shaft 97 form graduates of the visual position indicator, and the rear end face of the inspection coupler 118 forms a reference line of the visual position indicator. The grooves (graduates) 117*a*, 117*b*, 117*c* are spaced equidistantly, and the first groove 117*a* and the third groove 117*c* are spaced by a distance equal to a maximum allowable range prescribed for the axial position of the coupling member 26*b*. The rear end face of the inspection coupler 118 (i.e., the reference line of the position indicator) and the circumferential grooves 117*a*, 117*b*, 117*c* on the inspection shaft 97 (i.e., the graduates of the position indicator) are arranged such that when a front end face of the inspection coupler 118 is in abutment with a rear end face of the coupling member 26*b* on the engine output shaft, as shown in FIG. 24, the rear end face of the inspection coupler 118 is located on or between the first circumferential groove 117*a* and the third circumferential groove 117*c* in the inspection shaft 97 as long as the axial position of the coupler member 26*b* provided on the engine output shaft 27 is in the prescribed allowable range. Accordingly, by visually observing the position of the rear end face of the inspection coupler 118 relative to the circumferential grooves 117*a*–117*c*, it is readily possible to determine whether or not the coupling member 26*b* on the engine output shaft 27 is correctly positioned with respect to the axial direction of the rotating shaft 24 (FIG. 1) of the jet pump 20.

The visual position indicator composed of the rear end face of the inspection coupler 118 and the circumferential grooves 117*a*–117*c* in the inspection shaft 97 may be replaced by an axial position sensor 119 provided on the inspection coupler 118, the sensor 119 being reactive to only a limited part (fore-end) 120 of the inspection shaft 97. The sensor 119 and the limited shaft part 120 are arranged in the same manner as the rear end face of the inspection coupler 118 and the circumferential grooves 117*a*–117*c* in the inspection shaft 97. The position sensor 119 may include a photosensor. As previously discussed with respect to the first embodiment shown in FIGS. 1 through 20, the engine lower part dummy 32 is secured to the engine mounts 16, and after that the thrust plate 21 is attached to the vertical wall 19*a* of the jet pump chamber 19. As an alternative, the thrust plate 21 may be attached to the vertical wall 19*a* before the engine lower part dummy 32 is secured to the engine mounts 16. Furthermore, the small planing watercraft 10, with which the engine alignment jig assemblies 30, 90, 95, 110, 115 of the present invention are used, is a jet propulsion boat having a jet pump 20 as a drive or propulsion unit. The propulsion unit should by no means be limited to the jet pump 20 in the illustrated embodiment but may include a screw drive unit having a rotating shaft connected with a screw-propeller.

Obviously, various minor changes and modifications are possible in the light of the above teaching. It is to be understood that within the scope of the appended claims the present invention may be practiced otherwise than as specifically described.

The present disclosure relates to the subject matter of Japanese Patent Application No. 2002-002216, filed Jan. 9, 2002, the disclosure of which is expressly incorporated herein by reference in its entirety.

What is claimed is:

1. An engine alignment jig assembly used for installing an engine in a hull of a small watercraft via four engine mounts in such a manner that an output shaft of the engine is in alignment with a rotating shaft of a propulsion unit of the watercraft, the engine alignment jig assembly comprising:

an engine positioning jig for positioning the engine mounts relative to the rotating shaft of the propulsion unit, the engine positioning jig including an engine lower part dummy constructed to resemble a lower half of the engine, the engine lower part dummy including a generally rectangular skeleton frame having substantially the same size in plan view as the lower half of the engine, four screws each provided at a respective corner of the rectangular skeleton frame and adapted to be threaded in a corresponding one of the engine mounts to attach the engine lower part dummy to the engine mounts, wherein two adjacent ones of the screws that are disposed on a bow side of the watercraft form left and right front screws, and the remaining two screws that are disposed on a stern side of the watercraft opposite the bow side form left and right rear screws, a front through-hole formed in the skeleton frame with a center thereof disposed between the left and right front screws and aligned with an axis of the rotating shaft of the propulsion unit, and a rear through-hole formed in the skeleton frame with a center thereof disposed between the left and right rear screws and aligned with the axis of the rotating shaft of the propulsion unit.

2. The engine alignment jig assembly according to claim 1, wherein the engine positioning jig further includes a centering shaft adapted to be inserted through the front and rear through-holes of the engine lower part dummy while assuming a position of the rotating shaft of the propulsion unit, so as to position the engine mounts with respect to a vertical direction, a widthwise direction and a lengthwise direction of the watercraft through displacements of the engine lower part dummy in the respective directions relative to the centering shaft.

3. The engine alignment jig assembly according to claim 2, wherein the front through-hole of the engine lower part dummy has an inside diameter smaller than an inside diameter of the rear through-hole, the centering shaft includes a first portion and a second portion coaxial with each other and adapted to be simultaneously received in the front and rear through-holes, respectively, such that a loose fit is formed between each of the through-holes and a corresponding one of the shaft portions, and the engine positioning jig further includes means for determining an offset in the vertical direction of the center of each through-hole from an axis of the corresponding shaft portion.

4. The engine alignment jig assembly according to claim 3, wherein the means for determining an offset comprises a gauge block having a series of steps formed on one side thereof and adapted to be inserted between each through-hole and the corresponding shaft portion.

5. The engine alignment jig assembly according to claim 4, wherein the skeleton frame has a groove extending radially outward in a vertical direction from each of the front and rear through-holes for receiving part of the gauge block.

6. The engine alignment jig assembly according to claim 3, wherein the means for determining an offset comprises an ultrasonic depth indicator provided on the skeleton frame adjacent each of the front and rear through-holes for measuring a vertical thickness of a clearance between each through-hole and the corresponding shaft portion.

7. The engine alignment jig assembly according to claim 3, wherein the centering shaft further includes a third portion and a fourth portion coaxial with each other and adapted to be simultaneously received in the front and rear through-holes, respectively, such that a sliding fit is formed between each of the through-holes and a corresponding one of the shaft portions, the third and fourth shaft portions being disposed behind the first and second shaft portions, respectively, when viewed in a direction of insertion of the centering shaft through the front and rear through-holes.

8. The engine alignment jig assembly according to claim 7, wherein the engine lower part dummy further includes a lock device engageable with a part of the centering shaft to lock the engine lower part dummy in position against movement relative to the centering shaft in an axial direction of the centering shaft.

9. The engine alignment jig assembly according to claim 8, wherein the centering shaft further has a circumferential groove disposed adjacent the third shaft portion, and the lock device has a hollow case mounted to the skeleton frame adjacent the front through-hole and having an open end facing toward a common axis of the front and rear through-holes, a pair of locking prongs slidably received in the case and snugly receivable in the circumferential groove of the centering shaft, and a spring acting between the case and the locking prongs to urge the locking prongs in a direction to project outward from the open end of the case.

10. The engine alignment jig assembly according to claim 9, wherein the locking prongs are symmetrical in configuration with respect to a vertical plane passing through the center of the front through-hole.

11. The engine alignment jig assembly according to claim 2, for use with a watercraft having a propulsion unit composed of a jet pump mounted via a thrust plate to a vertical wall of the hull, wherein the engine positioning jig further includes a pump dummy adapted to be mounted to the thrust plate and having a plurality of coaxial support holes slidably receptive of longitudinal portions of the centering shaft for supporting the centering shaft in such a manner that the centering shaft assumes the position of the rotating shaft of the jet pump.

12. The engine alignment jig assembly according to claim 11, wherein the centering shaft further includes a semicircular flange, and the pump dummy has a substantially semicircular locking projection extending along a half of the perimeter of one of the support holes and releasably engageable with the semicircular flange to lock the centering shaft in position against axial movement relative to the pump dummy.

13. The engine alignment jig assembly according to claim 1, for use with a watercraft having a propulsion unit composed of a jet pump mounted via a thrust plate to a vertical wall of the hull, and a pair of coupling members provided on the output shaft of the engine and an rotating shaft of the jet pump to join the output shaft and the rotating shaft, further comprising:

a position inspection jig for inspecting the position of the output shaft of the engine which has been mounted on the engine mounts positioned by using the engine positioning jig, the position inspection jig including an inspection pump dummy adapted to be mounted to the thrust plate and having a plurality of support holes coaxial with the rotating shaft of the jet pump, an inspection shaft adapted to be inserted through the support holes of the inspection pump dummy so as to assume the position of the rotating shaft of the jet pump, and an inspection coupler adapted to be slidably mounted on an end portion of the inspection shaft for movement toward and away from one coupling member on the output shaft so as to inspect the coupling member for axial position and alignment error relative to the other coupling member on the rotating shaft of the jet pump.

14. The engine alignment jig assembly according to claim 13, wherein the position inspection jig further includes a lock device for locking the inspection shaft in position against axial movement relative to the inspection pump dummy, the inspection coupler has a cylindrical wall having an inside diameter slightly larger than an outside diameter of the coupling member provided on the output shaft for fitting engagement with an outer circumferential surface of the coupling member, and a locking device for locking the inspection coupler in position against movement relative to the inspection shaft when the inspection coupler is located in a predetermined inspecting position in which the inspection coupler is spaced a distance from the coupling member on the output shaft.

15. The engine alignment jig assembly according to claim 14, wherein the lock device of the position inspection jig includes a radial lock pin having opposite ends projecting radially outward form a circumferential surface of the inspection shaft, and a circular locking socket extending around one of the support holes for interlocking engagement with the rock pin, the locking socket having an oblong hole extending radially across the center of the circular locking socket to allow the lock pin to enter the locking socket.

16. The engine alignment jig assembly according to claim 14, wherein the locking device of the inspection coupler includes a radial locking hole formed in the end portion of the inspection shaft, and a locking knob having a threaded shank threaded in the inspection coupler and having a positioning pin formed at a front end of the threaded shank, the positioning pin being receivable in the radial locking hole of the inspection shaft.

17. The engine alignment jig assembly according to claim 13, wherein the position inspection jig further includes a lock device for locking the inspection shaft in position against axial movement relative to the inspection pump dummy, the inspection coupler has a cylindrical wall having an inside diameter slightly larger than an outside diameter of the coupling member provided on the output shaft for fitting engagement with an outer circumferential surface of the coupling member, and an axial position sensor disposed on the inspection coupler for detecting the arrival of the inspection coupler at a predetermined inspecting position in which the inspection coupler is spaced a distance from the coupling member on the output shaft.

18. The engine alignment jig assembly according to claim 17, wherein the axial position sensor comprises a photosensor.

19. The engine alignment jig assembly according to claim 18, wherein the position inspection jig further includes an additional ultrasonic depth indicator provided on the inspection coupler for measuring an axial distance between the inspection coupler and the coupling member on the output shaft.

20. The engine alignment jig assembly according to claim 17, wherein the position inspection jig further includes at least three ultrasonic depth indicators provided on the cylindrical wall of the inspection coupler and spaced at equal angular intervals in a circumferential direction of the cylindrical wall for indicating the amount of an alignment error of the output shaft relative to the rotating shaft.

21. The engine alignment jig assembly according to claim 17, wherein the position inspection jig further includes a lock device for locking the inspection shaft in position against axial movement relative to the inspection pump dummy, the inspection coupler has a cylindrical wall having an inside diameter slightly larger than an outside diameter of the coupling member provided on the output shaft for fitting engagement with an outer circumferential surface of the coupling member, and a visual position indicator for visually indicating the position of the inspection coupler relative to the inspection shaft to determine whether not the coupling member on the output shaft is in a correct position relative to the coupling member on the rotating shaft when the inspection coupler is in abutment with the coupling member on the output shaft.

22. The engine alignment jig assembly according to claim 21, wherein the visual position indicator comprises a rear end face of the inspection coupler forming a reference line of the position indicator, and three circumferential grooves formed in the end portion of the inspection shaft for forming graduates of the position indicator, the three circumferential grooves are spaced equidistantly and two of the three circumferential grooves that are disposed on opposite side of the remaining circumferential groove are spaced by a distance equal to a maximum allowable range of the axial position of the output shaft of the engine.

23. The engine alignment jig assembly according to claim 22, wherein the position inspection jig further includes at least three ultrasonic depth indicators provided on the cylindrical wall of the inspection coupler and spaced at equal angular intervals in a circumferential direction of the cylindrical wall for indicating the amount of an alignment error of the engine output shaft relative to the rotating shaft.

24. A method of installing an engine in a hull of a small watercraft via four engine mounts in such a manner that an output shaft of the engine is in alignment with a rotating shaft of a propulsion unit of the watercraft, the method comprising the steps of:

providing an engine positioning jig for positioning the engine mounts relative to the rotating shaft of the propulsion unit, the engine positioning jig including an engine lower part dummy constructed to resemble a lower half of the engine, the engine lower part dummy including a generally rectangular skeleton frame having substantially the same size in plan view as the lower half of the engine, four screws each provided at a respective corner of the rectangular skeleton frame and adapted to be threaded in a corresponding one of the engine mounts to attach the engine lower part dummy to the engine mounts, wherein two adjacent ones of the screws that are disposed on a bow side of the watercraft form left and right front screws, and the remaining two screws that are disposed on a stern side of the watercraft opposite the bow side form left and right rear screws, a front through-hole formed in the skeleton frame with a center thereof disposed between the left and right front screws and aligned with an axis of the rotating shaft of the propulsion unit, and a rear through-hole formed in the skeleton frame with a center thereof disposed between the left and right rear screws and aligned with the axis of the rotating shaft of the propulsion unit;

fixedly mounting the engine lower part dummy on the engine mounts while the engine mounts are kept temporarily fastened to the hull in such a manner that the engine mounts are allowed to move in all of a vertical direction, a widthwise direction and a lengthwise direction of the watercraft to some extent;

positioning the engine mounts in the vertical direction, widthwise direction and lengthwise direction, respectively, of the watercraft through displacements of the engine lower part dummy in the respective directions relative to the rotating shaft;

then, firmly securing the engine mounts to the hull;

thereafter, removing the engine lower part dummy from the engine mounts; and finally, mounting the engine on the engine mounts to thereby install the engine in the hull of the watercraft.

25. The method according to claim 24, wherein the step of positioning the engine mounts is achieved by:

inserting a centering shaft through the front and rear through-holes of the engine lower part dummy while supporting the centering shaft in such a manner that the centering shaft assumes a position of the rotating shaft of the propulsion unit;

determining an offset in the vertical direction of the center of each through-hole from an axis of the centering shaft;

canceling out the offset to thereby achieve positioning of the engine mounts in the vertical direction of the watercraft;

then, performing positioning of the engine mounts in the widthwise direction of the watercraft while the centering shaft is used as a reference for the widthwise positioning; and thereafter, performing positioning of the engine mounts in the lengthwise direction of the watercraft while the centering shaft is used as a reference for the lengthwise positioning.

26. The method according to claim 25, wherein the front through-hole of the engine lower part dummy has an inside diameter smaller than an inside diameter of the rear through-hole, the engine lower part dummy further has a spring loaded locking device for interlocking engagement with a circumferential groove formed in the centering shaft, the centering shaft includes a first portion and a second portion coaxial with each other and adapted to be simultaneously received in the front and rear through-holes, respectively, such that a loose fit is formed between each of the through-holes and a corresponding one of the first and second shaft portions, the centering shaft further including a third portion and a fourth portion coaxial with each other and adapted to be simultaneously received in the front and rear through-holes, respectively, such that a sliding fit is formed between each of the through-holes and a corresponding one of the third and fourth shaft portions, the third and fourth shaft portions being disposed behind the first and second shaft portions, respectively, when viewed in a direction of insertion of the centering shaft through the front and rear through-holes, wherein the determining an offset is achieved by:

advancing the centering shaft in the direction of insertion until the first and second shaft portions are loosely received in the front and rear through-holes, respectively; and measuring the thickness of a clearance formed between each of the first and second shaft portions and a corresponding one of the front and rear through-holes in the vertical direction, wherein the performing positioning of the engine mount in the widthwise direction is achieved by:

while the engine lower part dummy is being slightly displaced in the widthwise direction relative to the centering shaft, further advancing the centering shaft in the direction of insertion until the third and fourth shaft portions are slidably received in the front and rear through-holes, respectively, and wherein the performing positioning of the engine mounts in the lengthwise direction is carried out by:

displacing the engine lower part dummy in an axial direction of the centering shaft until the spring-loaded locking device on the engine lower part dummy fits in the circumferential groove of the centering shaft.

27. The method according to claim 26, wherein the canceling out the offset is achieved by:

selecting a shim having a thickness determined on the basis of a thickness of the measured clearance; and placing the shim between a respective engine mount and the hull of the watercraft.

28. The method according to claim 26, wherein the measuring the thickness of a clearance is carried out by insetting a gauge block into the clearance, the gauge block having a series of steps on one side thereof.

29. The method according to claim 26, wherein the measuring the thickness of a clearance is carried out by activating an ultrasonic depth indicator provided on the skeleton frame adjacent each of the front and rear through-holes, the ultrasonic depth indicator being disposed in a vertical plane passing through the center of the respective through-hole.

30. The method according to claim 25, for use with a watercraft having a propulsion unit composed of a jet pump mounted via a thrust plate to a vertical wall of the hull, and a pair of coupling members provided on the output shaft of the engine and an rotating shaft of the jet pump to join the output shaft and the rotating shaft, further comprising the steps of:

attaching an inspection pump dummy to the thrust plate, the inspection pump dummy being so shaped to resemble the jet pump and having a plurality of coaxial support holes aligned with a rotating shaft of the jet pump;

then, inserting an inspection shaft through the support holes of the inspection pump dummy so that the inspection shaft is supported in a position to assume a position of the rotating shaft of the jet pump; and thereafter, performing an inspection of the output shaft for axial position and alignment error relative to the inspection shaft.

31. The method according to claim 30, wherein the performing an inspection of the output shaft comprises:

mounting an inspection coupler on a fore-end portion of the inspection shaft so that the inspection coupler is slidably movable along the inspection shaft in a direction toward and away from the coupler provided on the engine output shaft, the inspection coupler including a cylindrical wall having an inside diameter slightly larger than an outside diameter of the coupling member on the output shaft;

then, displacing the inspection coupler along the inspection shaft until the inspection coupler is located in a predetermined inspecting position where the inspection coupler is spaced a distance from the coupling member on the output shaft in the axial direction of the inspection shaft;

thereafter, measuring an axial space between the inspection coupler and the coupling member to thereby determine whether or not the output shaft is correctly positioned in the lengthwise direction of the watercraft; and subsequently, displacing the inspection coupler toward the coupling member on the output shaft to thereby determine whether or not the output shaft is in correct alignment with the rotating shaft of the jet pump depending on the occurrence of a fitting engagement between the cylindrical wall of the inspection coupler and the coupling member on the output shaft.

32. The method according to claim 31, wherein, when the fitting engagement between the cylindrical wall of the inspection coupler and the coupling member on the output occurs, the amount of an alignment error is measured by at least three ultrasonic depth indicators provided on the cylindrical wall of the inspection coupler and spaced at equal intervals in a circumferential direction of the cylindrical wall.

33. The method according to claim 30, wherein the performing an inspection of the output shaft comprises:

mounting an inspection coupler on a fore-end portion of the inspection shaft so that the inspection coupler is slidably movable along the inspection shaft in a direction toward and away from the coupler provided on the engine output shaft, the inspection coupler including a cylindrical wall having an inside diameter slightly larger than an outside diameter of the coupling member on the output shaft;

then, displacing the inspection coupler toward the coupling member on the output shaft to thereby determine whether or not the output shaft is in correct alignment with the rotating shaft of the jet pump depending on the occurrence of a fitting engagement between the cylindrical wall of the inspection coupler and the coupling member on the output shaft, further displacing the inspection coupler toward the coupling member until the inspection coupler is located in a predetermined inspecting position where the inspection coupler is spaced a distance from the coupling member on the output shaft in the axial direction of the inspection shaft; and thereafter, measuring an axial space between the inspection coupler and the coupling member to thereby determine whether or not the output shaft is correctly positioned in the lengthwise direction of the watercraft.

34. The method according to claim 33, wherein the axial space between the inspection coupler and the coupling member is measured by an ultrasonic depth indicator provided on the inspection coupler.

35. The method according to claim 33, wherein, when the fitting engagement between the cylindrical wall of the inspection coupler and the coupling member on the output occurs, the amount of an alignment error is measured by at least three ultrasonic depth indicators provided on the cylindrical wall of the inspection coupler and spaced at equal intervals in a circumferential direction of the cylindrical wall.

36. The method according to claim 30, wherein the performing an inspection of the output shaft comprises:

mounting an inspection coupler on a fore-end portion of the inspection shaft so that the inspection coupler is slidably movable along the inspection shaft in a direction toward and away from the coupler provided on the engine output shaft, the inspection coupler including a cylindrical wall having an inside diameter slightly larger than an outside diameter of the coupling member on the output shaft and a rear end surface serving as a reference line of a visual axial position indicator, and the inspection shaft having three circumferential grooves spaced equidistantly with two outer grooves spaced by a distance equal to a maximum allowable range of the axial position of the output shaft;

then, displacing the inspection coupler toward the coupling member on the output shaft to thereby determine whether or not the output shaft is in correct alignment with the rotating shaft of the jet pump depending on the occurrence of a fitting engagement between the cylindrical wall of the inspection coupler and the coupling member on the output shaft, further displacing the inspection coupler toward the coupling member until the inspection coupler abuts on the coupling member; and thereafter, checking the position of the rear end face of the inspection coupler relative to the circumferential grooves of the inspection shaft to thereby determine whether or not the output shaft is correctly positioned in the lengthwise direction of the watercraft.

37. The method according to claim 36, wherein, when the fitting engagement between the cylindrical wall of the inspection coupler and the coupling member on the output occurs, the amount of an alignment error is measured by at least three ultrasonic depth indicators provided on the cylindrical wall of the inspection coupler and spaced at equal intervals in a circumferential direction of the cylindrical wall.

* * * * *